US006401684B2

(12) United States Patent
Hori et al.

(10) Patent No.: US 6,401,684 B2
(45) Date of Patent: Jun. 11, 2002

(54) SYSTEM FOR CONTROLLING ENGINE EQUIPPED WITH ELECTROMAGNETICALLY OPERATED ENGINE VALVE

(75) Inventors: Toshio Hori; Hidefumi Iwaki; Shigeyuki Nonomura, all of Ibaraki; Keisuke Fujiwara; Hirofumi Yano, both of Yokohama, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/736,576

(22) Filed: Dec. 15, 2000

(30) Foreign Application Priority Data

Dec. 16, 1999 (JP) ..... 11-357638

(51) Int. Cl.[7] ..... F02B 77/00

(52) U.S. Cl. ..... 123/198 F; 123/630; 123/90.11; 123/198 DC

(58) Field of Search ..... 123/198 F, 90.11, 123/198 DC, 630

(56) References Cited

FOREIGN PATENT DOCUMENTS

JP 8-200135 8/1996

*Primary Examiner*—Tony M. Argenbright
*Assistant Examiner*—Katrina B. Harris
(74) *Attorney, Agent, or Firm*—Foley & Lardner

(57) ABSTRACT

An engine control system for an engine system with electromagnetically operated intake and exhaust valves has a control unit. The control unit is arranged to decide whether each of the intake and exhaust valves is put in an abnormal condition, to close a normal valve of the intake and exhaust valves when one of the intake and exhaust valves is put in the abnormal condition, and to stop the current-flowing to a primary ignition coil when one of the intake and exhaust valves is put in the abnormal condition and when the primary ignition coil is not starting the current-flowing.

22 Claims, 15 Drawing Sheets

A/F
Qa
N
θa
N, Qa
L
N, Qa
α
T = α · Ta
Ta = k · Qa/4N
Qa CORRECTION
CHANGE COMMAND
θth
Qt
IDLING CHANGE
ABNORMALITY DETECTION
IGNITION TIMING
RETARD COMMAND
CYLINDER DISTRIBUTION
STOP COMMAND
CORRECT STOP
RESPONSE CORRECTION
OPENING AND CLOSING TIMING
RECOVERY CONTROL
CLOSE COMMAND
DRIVE CIRCUIT
M
L
a
22
7
18
17
42
43
41
44
65
66
67
46
45
68
48
49
47
64
79
63
62
58
59
57
61
51
52
72
73
76
75
80
88
87
86
85
13
4
34
2
3
16
40

SYSTEM FOR CONTROLLING ENGINE EQUIPPED WITH ELECTROMAGNETICALLY OPERATED ENGINE VALVE

BACKGROUND OF THE INVENTION

The present invention relates to a control system for an engine system equipped with intake and exhaust valves operated by electromagnetic actuators, and more particularly to a control system which is arranged to adaptively control an engine system when one of intake and exhaust valves is put in an abnormal condition.

Japanese Patent Provisional Publication No. 8-200135 discloses a control system of an engine system with electromagnetically operated intake and exhaust valves. This engine system is arranged to stop a fuel injection and to close at least one of intake and exhaust valves when an abnormal operation of one of the valves is detected.

SUMMARY OF THE INVENTION

However, even if an abnormality of a valve is detected after the fuel injection by the conventional control system, a combustion stroke is once executed at a cylinder having the abnormal valve before stopping the fuel injection. This may degrade the parts in an intake passage or exhaust passage.

It is an object of the present invention to provide an engine control system which is capable of suppressing the degradation of parts for an engine even if electromagnetically operated intake and exhaust valves are put in an abnormal condition.

An engine control system according to the present invention is for an engine system which comprises electromagnetically operated intake and exhaust valves, a spark plug, a primary ignition coil, a secondary ignition coil generating an induction voltage according to current-flowing and current-stopping operations to the primary ignition coil, the secondary ignition coil outputting the induction voltage to the spark plug. The engine control system comprises a control unit which is arranged to decide whether each of intake and exhaust valves is put in an abnormal condition, to close a normal valve of the intake and exhaust valves when one of the intake and exhaust valves is put in the abnormal condition, and to stop the current-flowing of the primary ignition coil when one of the intake and exhaust valves is put in the abnormal condition and when the primary ignition coil does not start the current-flowing.

DETAILED DESCRIPTION OF THE INVENTION

Referring to FIGS. 1 to 24, there is shown an embodiment of an engine control system employed in an engine system in accordance with the present invention.

Figure 1:
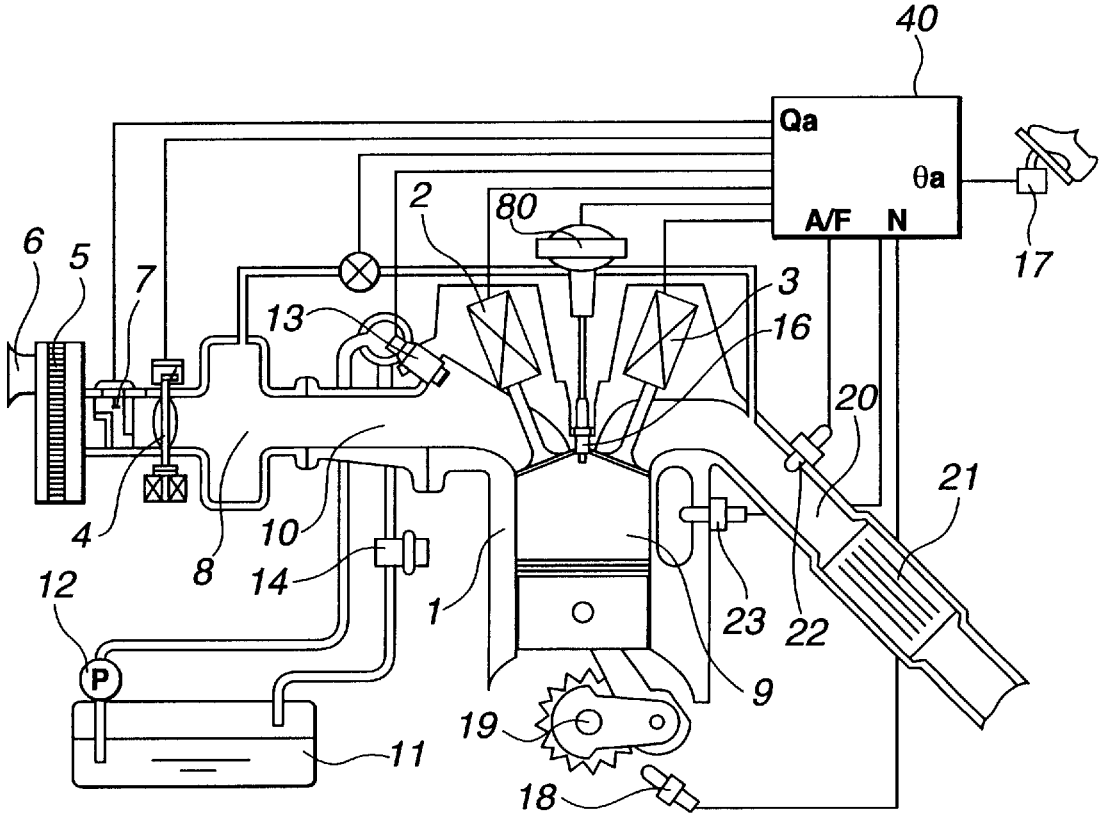
FIG. 1 is a schematic view showing an engine system according to an embodiment of the present invention.

With reference to FIG. 1, there will be discussed the engine system, to which the engine control system according to the present invention is employed. As shown in FIG. 1, an internal combustion engine 1 of a four-cylinder four-cycle type sucks air from an inlet port 6 of an air cleaner 5. The sucked air flows to a corrector 8 through an airflow meter 7 for measuring an intake air quantity Qa and an electronically controlled throttle valve 4. The air in the corrector 8 is distributed to intake ports 10 respectively connected to four cylinders 9 of engine 1, and is then led to each combustion chamber of each cylinder 9. On the other hand, a fuel pump 12 sucks fuel from a fuel tank 11 and pressurizes the sucked fuel. The pressure of the pressurized fuel is controlled at predetermined pressure (3 $kg/cm^2$) by means of a fuel pressure regulator 14. The pressure-controlled fuel is injected into each intake port 10 from injector 13. The injected fuel is ignited in the combustion chamber of each cylinder 9 by means of a spark plug 16. Exhaust gases in the combustion chamber of cylinder 9 is discharged into atmosphere through a catalyst 21 provided in an exhaust gas passage 20.

A control unit 40 is connected to airflow meter 7, a temperature sensor 23 provided to cylinder 9, an air-fuel ratio sensor 22 provided to exhaust passage 20, a crank angle sensor 18 for detecting a rotation speed of a crankshaft 19, and an accelerator depression quantity sensor 17 for detecting a depression quantity of an accelerator pedal and receives signals from these sensors 7, 23, 22, 19 and 17 as information for controlling engine 1.

Figure 2:
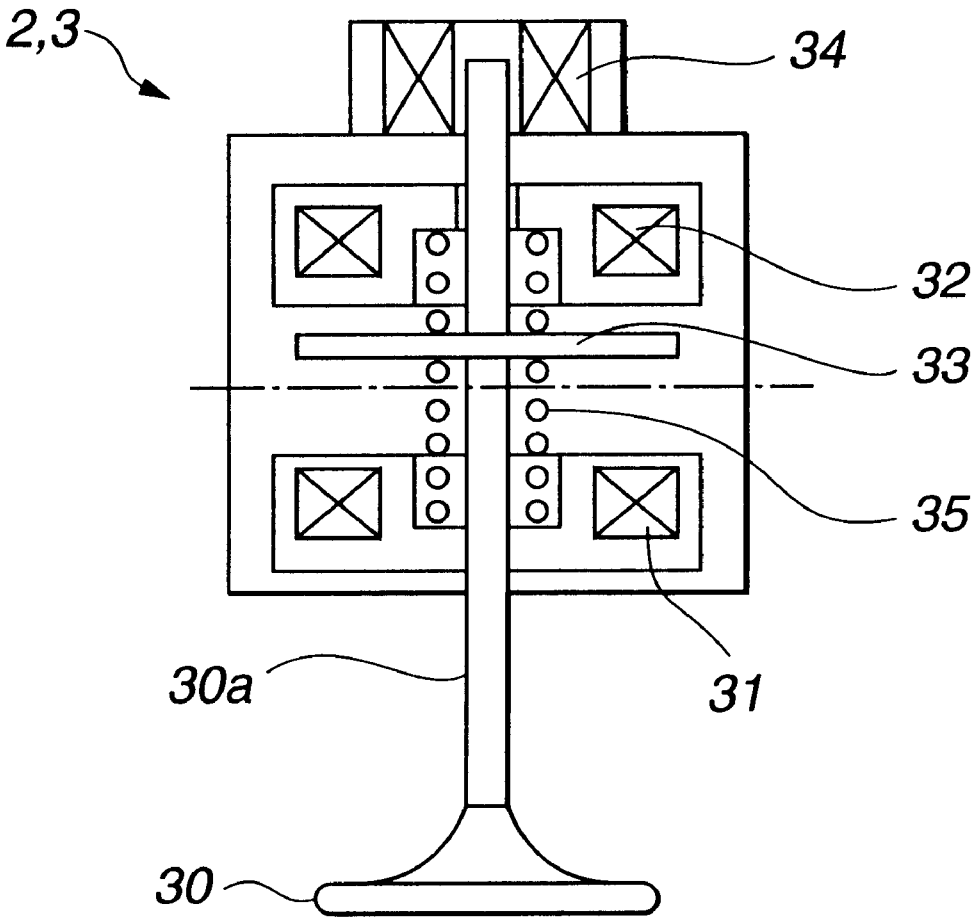
FIG. 2 is a cross-sectional view showing intake or exhaust valve employed in the engine system of FIG. 1.

Each cylinder 9 of engine 1 is provided with an intake valve 2 for opening and closing an intake port and an exhaust valve 3 for opening and closing an exhaust port. These valve units 2 and 3 are of an electromagnetically operated type. As shown in FIG. 2, each of intake and exhaust valves 2 and 3 comprises a valve body 30, an opening electromagnetic coil 32 for moving valve body 30 toward an opening direction, a closing electromagnetic coil 31 for moving valve body 30, a movable member 33 attracted to electromagnetic coils 31 and 32, and a pair of coil springs 35 for biasing movable member 33 at a neutral position between electromagnetic coils 31 and 32.

Movable member 33 is fixed to a valve shaft portion 30*a* of valve body 30. Electromagnetic coils 31 and 32 is penetrated by valve shaft portion 30*a*. Coil springs 35 are provided between opening electromagnetic coil 31 and movable member 33 and between closing electromagnetic coil 32 and movable member 33, respectively. A lift quantity sensor 34 for detecting a lift quantity of valve body 30 is installed to each of intake and exhaust valves 2 and 3, as shown in FIG. 2.

When engine 1 is stopping, both electromagnetic coils 31 and 32 are put in a turn-off condition. Therefore, during this engine stop condition, movable member 33 is positioned at the neutral position shown by a dot and dash line in FIG. 2. Valve body 30 is opened at a full lift position by operating (turning-on) opening electromagnetic coil 31, and is closed at a full close position by operating (turning-on) closing electromagnetic coil 32. Lift quantity sensor 34 detects the neutral position, the full lift position (full open position) and the full close position.

Figure 9:
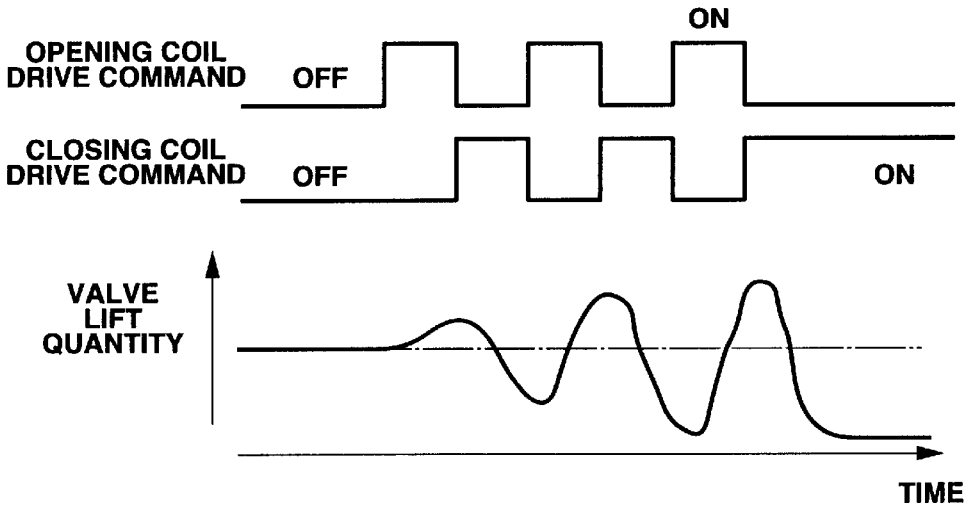
FIG. 9 is a time chart showing an initialization operation of the valve.
Figure 10:
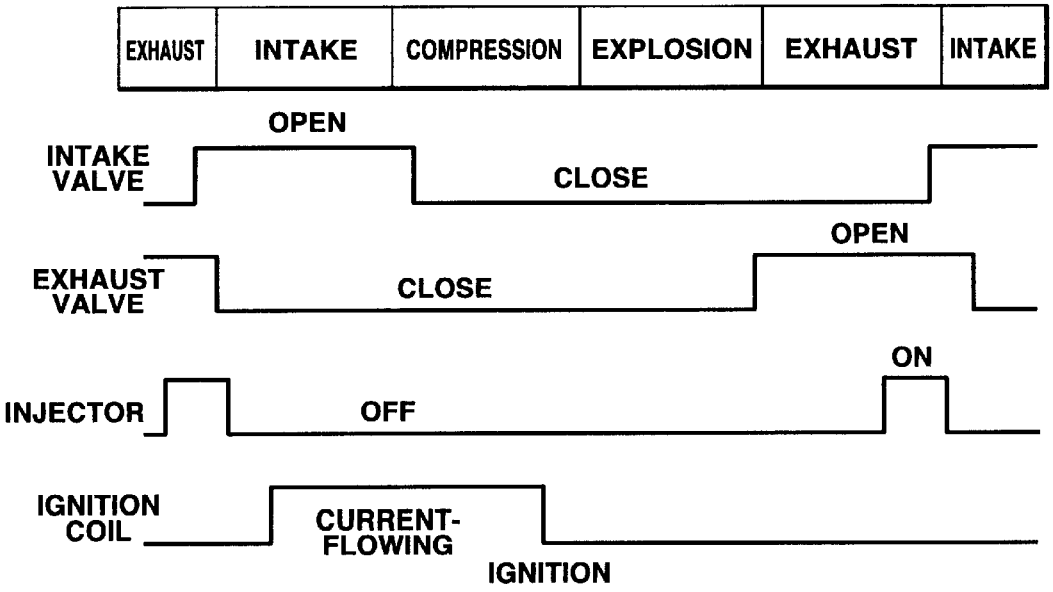
FIG. 10 is a time chart showing operating conditions of main parts in every stroke under a valve normal condition.

When engine 1 is started from the stopping condition where intake and exhaust valves 2 and 3 are positioned at the neutral position, a specific starting operation is executed as shown in FIG. 9 so as to put intake and exhaust valves 2 and 3 at the full close position within a short time period and with a small power consumption. First, both opening and closing electromagnetic coils 31 and 32 are put in the turn-off condition. Then, opening electromagnetic coil 31 is turned on for a predetermined time period. Next, closing electromagnetic coil 32 is turned on for the predetermined time period. Further, these alternative turning-on operations of opening and closing electromagnetic coils 31 and 32 are repeated. By properly setting the predetermined time period, the magnitude of valve body 30 is excited, and valve body 30 finally vibrates between the full open condition and the full close condition. Thereafter, closing electromagnetic coil 32 is kept at the turned-on condition so as to keep valve body 30 at the full close position. The start initializing operation of each valve 2, 3 decreases the power consumption since this initializing operation utilizes an excitation of the valve vibration. Throughout the specification, the above-mentioned starting initializing operation is called an initialization operation of valve 2, 3.

Figure 3:
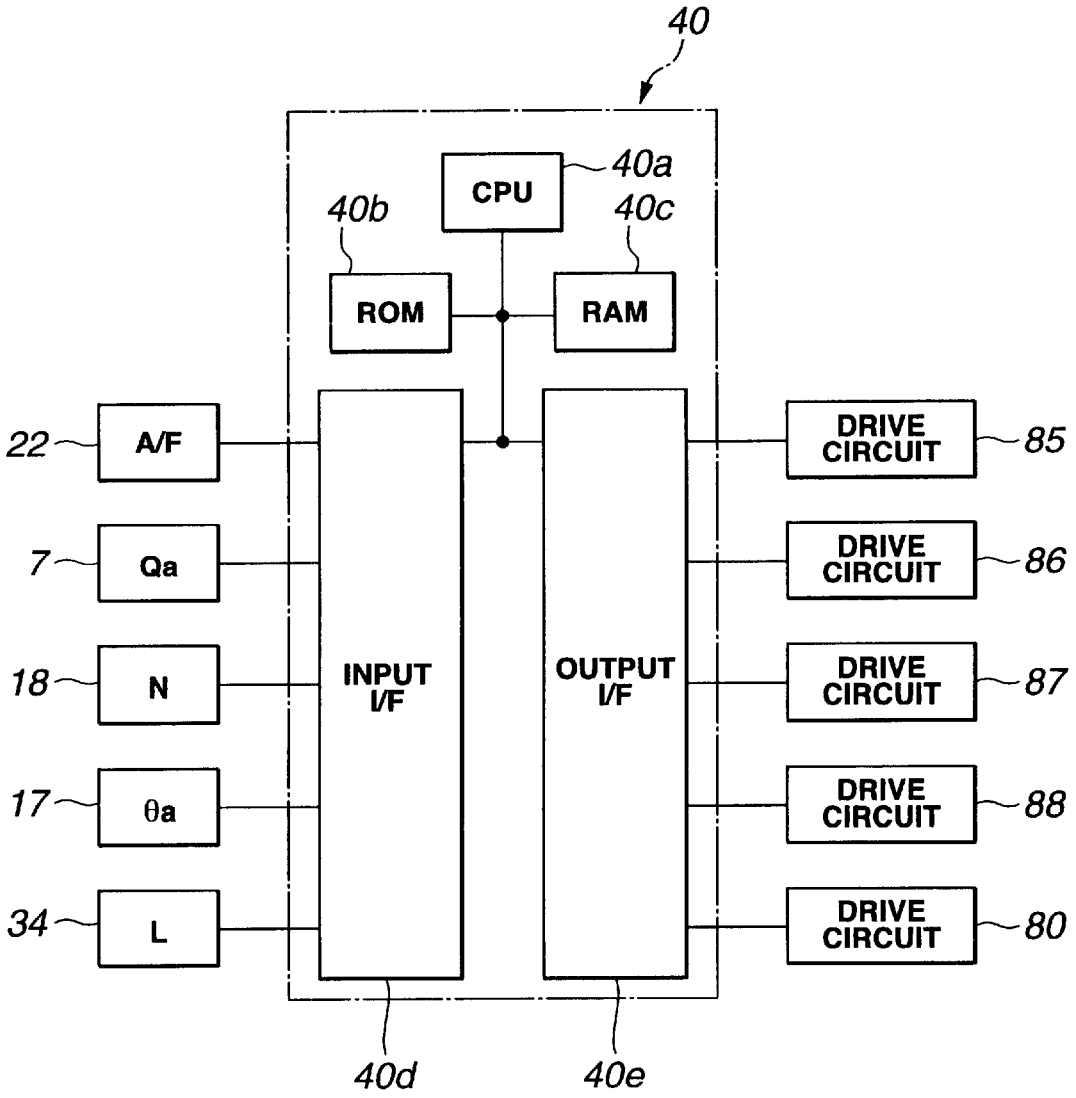
FIG. 3 is a block diagram showing an engine control unit of the embodiment.

As shown in FIG. 3, control unit 40 comprises CPU 40*a*, ROM 40*b* for storing programs and data, RAM 40*c* for temporally storing programs and data, input interface 40*d* for receiving signals of various sensors and output interface 40*e* for outputting control signals to drive circuits of various devices.

Figure 4:
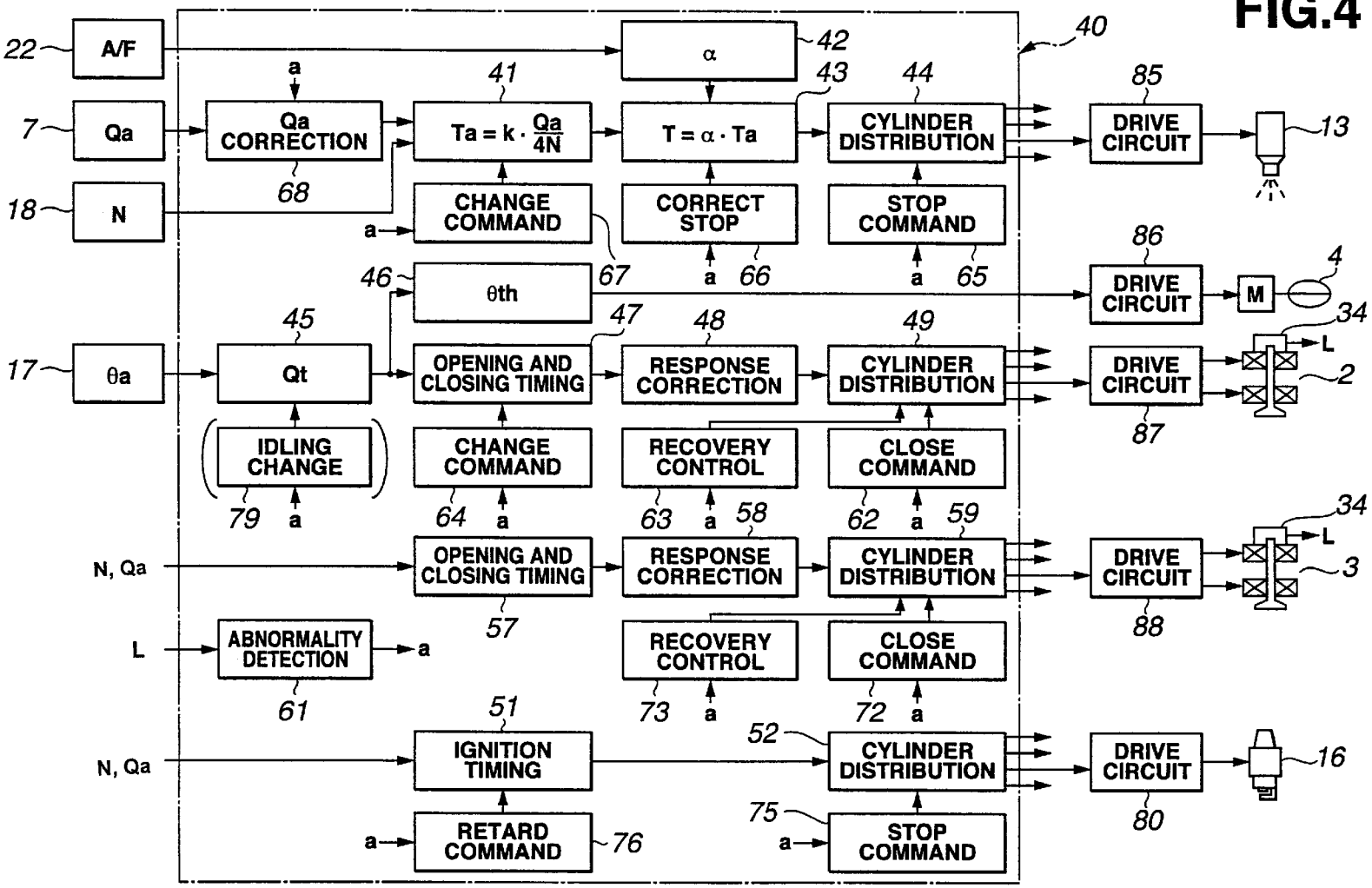
FIG. 4 is a functional block diagram of the engine control unit.

As shown in FIG. 4, control unit 40 comprises a basic fuel injection quantity calculating section 41, a correction coefficient calculating section 42, a fuel injection quantity correcting section 43, a fuel injection quantity cylinder distributing section 44, a target intake air quantity calculating section 45, a throttle opening calculating section 46, an opening and closing timing calculating section 47, a response correcting section 48, an opening and closing timing cylinder distributing section 49, an opening and closing timing calculating section 57, a response correcting section 58, an opening and closing timing cylinder distributing section 59, an ignition timing calculating section 51, and an ignition timing cylinder distributing section 52.

Basically, basic fuel injection quantity calculating section 41 calculates a basic fuel injection quantity Ta, in the form of basic fuel injection pulse width from an engine rotation speed N and a intake air quantity Qa as shown in FIG. 1. Correction coefficient calculating section 42 calculates a correction coefficient $\alpha$ for basic fuel injection quantity Ta for an air-fuel ratio A/F. Fuel injection quantity correcting section 43 calculates a fuel injection quantity by multiplying correction coefficient $\alpha$ with basic fuel injection quantity Ta. Fuel injection quantity cylinder distributing section 44 commands each injection drive circuit 85 for each cylinder to inject a fuel injection quantity. Target intake air quantity calculating section 45 calculates a target intake air quantity Qt from an air quantity for obtaining an engine output according to an accelerator depression quantity $\theta a$ and an air quantity necessary for obtaining an engine output of driving accessories of the vehicle. Throttle opening calculating section 46 calculates a throttle opening $\theta th$ of a throttle valve 4 from target intake air quantity Qt and commanding a throttle valve drive circuit 86 to achieve throttle opening $\theta th$. Opening and closing timing calculating section 47 calculates opening and closing timings of each intake valve 2 from target intake air quantity Qt and engine rotation speed N. Response correcting section 48 corrects each of valve opening and closing timings according to a response characteristic of intake valve 2. Opening and closing timing cylinder distributing section 49 commands an intake valve drive circuit 87 for each cylinder to achieve the corrected valve opening and closing timing. Opening and closing timing calculating section 57 calculates opening and closing timing of each exhaust valve 3 according to an engine operating condition. Response correcting section 58 corrects valve opening and closing timing according to a response characteristic of each exhaust valve 3. Opening and closing timing cylinder distributing section 59 commands each exhaust valve drive circuit 88 for each cylinder to achieve corrected opening and closing timing. Ignition timing calculating section 51 calculates an ignition timing of each spark plug 16 according to the engine operating condition. Ignition timing cylinder distributing section 52 commands each spark plug drive circuit 80 for each cylinder to achieve the calculating ignition timing.

More specifically, basic fuel injection quantity calculating section 41 calculates basic fuel injection quantity Ta per cylinder in a manner of dividing intake air quantity Qa (detected by an airflow meter 7) by engine rotation speed N (detected by a crank angle sensor 18) and by the number of cylinders of engine 1 (herein, the number is 4) and by multiplying a coefficient k to the value Qa/N/4 so as to bring the air-fuel ratio closer to the stoichiometric ratio (A/F=14.7). Correction coefficient calculating section 42 and fuel injection quantity calculating section 43 executes a feedback control of air-fuel ratio by correcting basic fuel injection quantity Ta to achieve a desired air-fuel ration on the basis of an actual air-fuel ratio A/F in exhaust gases detected by an air-fuel sensor 22.

Figure 5:
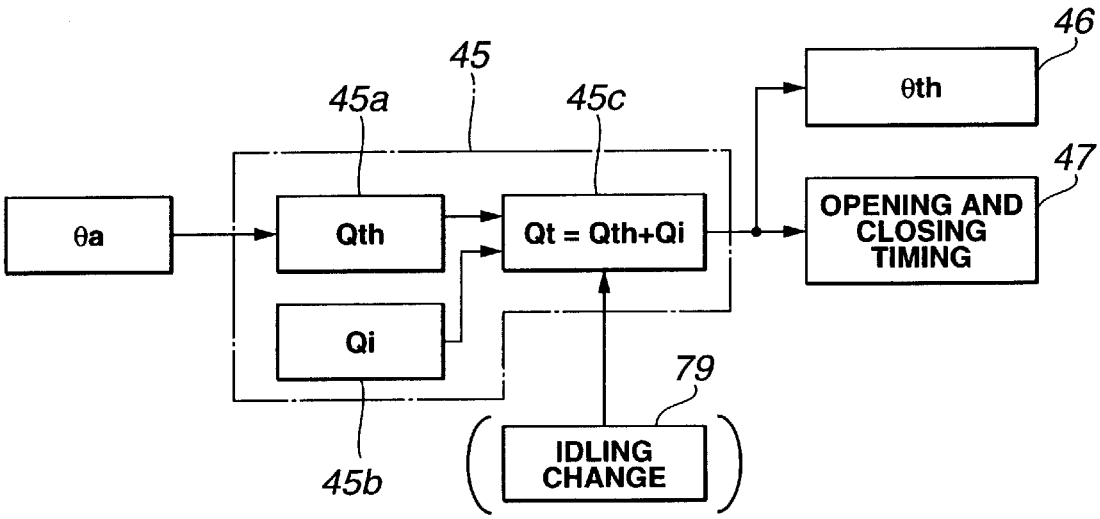
FIG. 5 is a block diagram showing a target intake-air quantity calculating section of an engine control unit in the embodiment according to the present invention.

As shown in FIG. 5, target intake air quantity calculating section 45 comprises an accelerator target intake air calculating section 45*a* for calculating a demanded air quantity Qth necessary for generating the engine output according to accelerator depression quantity θa, an accessory target air quantity calculating section 45*a* for calculating accessory demand air quantity Qi necessary for driving accessories, and a total target air quantity calculating section 45*c* for calculating a total target air quantity Qt by adding demanded air quantity Qth and accessory demand air quantity Qi (Qt=Qth+Qi).

Figure 7:
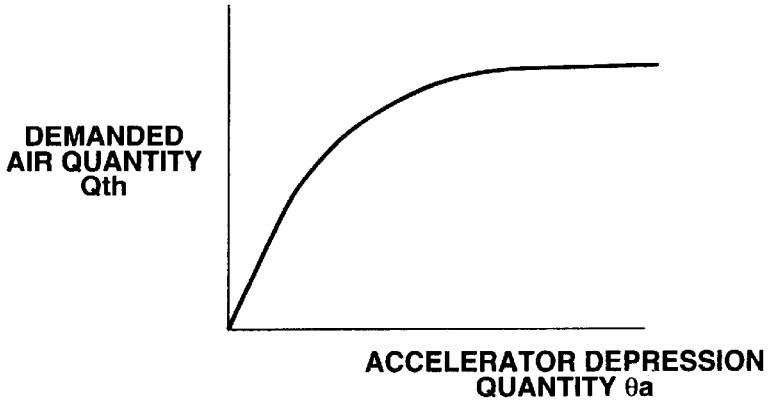
FIG. 7 is a graph showing a relationship between an accelerator depression quantity and a required intake-air quantity.
Figure 8:
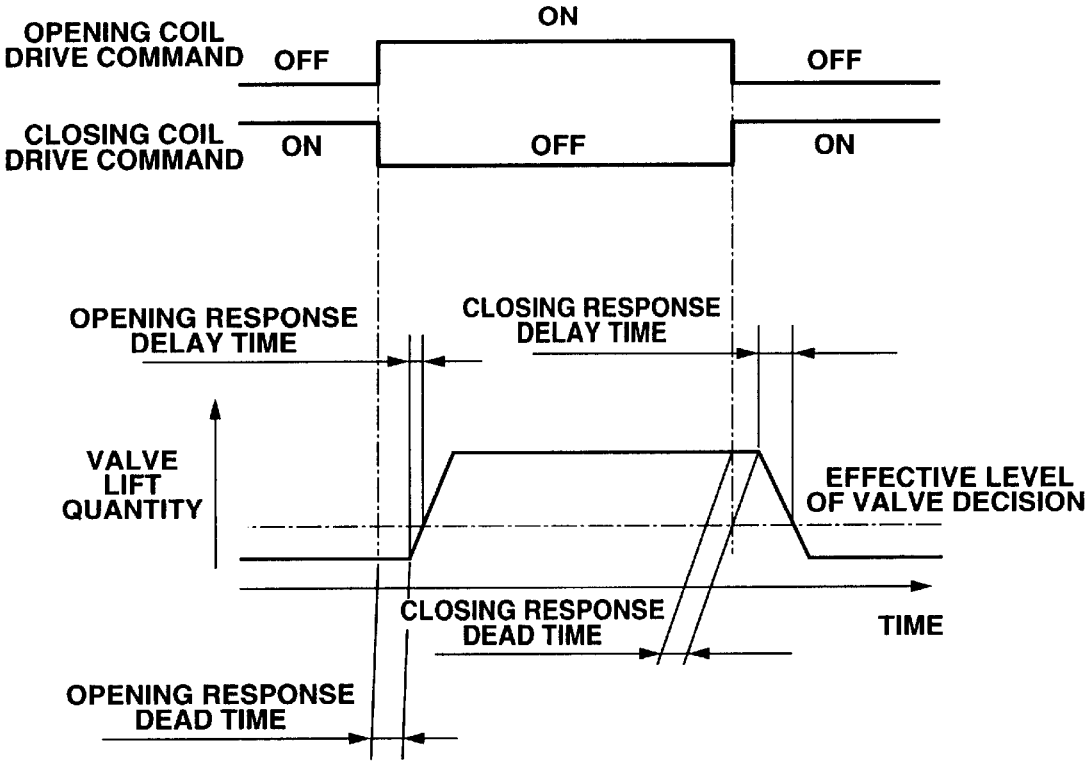
FIG. 8 is a time chart showing a response characteristic of a valve operated by an electromagnetic actuator.

More specifically, accelerator target air quantity calculating section 45*a* has stored a map corresponding to a relationship between accelerator depression quantity θa and demanded air quantity Qth as shown in FIG. 7. Therefore, accelerator target air quantity calculating section 45*a* calculates demanded air quantity Qth on the basis of the map corresponding to a graph of FIG. 7 according to accelerator depression quantity θa detected by accelerator depression sensor 17. Accessory target intake air quantity calculating section 45*b* calculates a demanded intake-air quantity necessary for maintaining the engine rotation speed at a target rotation speed under an idling condition, a demand intake-air quantity for driving accessories including an air conditioner, a generator, an oil pump for a power steering and so on, an intake-air quantity for a cruise control apparatus, and a negative intake-air quantity generated by a traction control.

An intake air quantity supplied to engine 1 is basically controlled by controlling opening and closing timing of intake valve 2. Throttle valve 4 acts as an assistant for controlling the intake air quantity. Therefore, intake-valve opening and closing timing calculating section 47 determines the intake valve opening timing according to a target driving condition of engine 1 upon taking account of inertia supercharge effect and addition of internal EGR. Target intake-air quantity calculating section 45 calculates an intake-valve opening time period for supplying total target intake-air quantity Qt into engine 1 and determines a closing timing from the calculated intake-valve opening period and the previously determined opening timing.

Response correcting sections 48 and 58 correct valve opening and closing timings according to the response characteristics of intake valve 2 and exhaust valve 3, respectively. That is, the intake and exhaust valves 2 and 3 generate dead time and delay time with respect to opening and closing commands to coils 31 and 32. Further, the valve response characteristics vary according to the circumstances of intake and exhaust valves 2 and 3. Response correcting section 48 and 58 estimate the valve circumstances and determine the output timing of the opening and closing coil commands so as to bring the actual opening and closing valve timing closer to desired timings, respectively.

Exhaust valve opening and closing timing calculating section 57 determines the opening and closing timing of exhaust valve 3 on the basis of the engine operating condition represented by the engine rotation speed N and the intake air quantity Qa. Ignition timing calculating section 51 determines the ignition timing of spark plug 16 on the basis of the engine condition represented by engine speed N and intake air quantity Qa.

Figure 6:
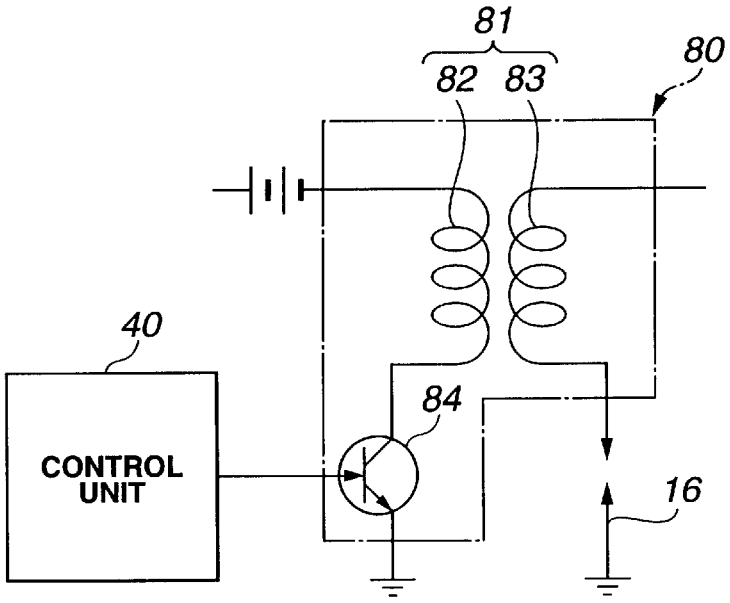
FIG. 6 is a circuit diagram of a spark plug drive circuit employed in the embodiment according to the present invention.

As shown in FIG. 6, spark plug drive circuit 80 comprises a primary ignition coil 82 for flowing electric current (receiving electric power) from the battery, a power transistor 84 for controlling the current flow to primary ignition coil 82, and a secondary ignition coil 83 for generating induction voltage by means of the change of current-flowing to primary ignition coil 82. A control unit 40 outputs a control signal to power transistor 84. Secondary ignition coil 83 generates the induction voltage to supply power to spark plug 16 at a moment when the current-flowing of primary ignition coil 82 is shut off.

Spark plug drive circuit 80 and spark plug 16 are provided to each cylinder. Ignition timing cylinder distributing section 52 outputs ignition control signals to objective one of ignition plug drive circuits 80 at proper timing.

Each set of injector drive circuit 85 and injector 13, intake valve drive circuit 87 and intake valve 2, and exhaust valve drive circuit 88 and exhaust valve 3 is also provided at each cylinder as is similar to the ignition plug drive circuit 80.

Each of fuel injection quantity cylinder distributing section 44, intake-valve opening and closing timing cylinder distributing section 49, exhaust-valve opening and closing timing cylinder distributing section 59 also outputs a control signal to objective one of corresponding four drive circuits at a proper timing, as is similar to ignition timing cylinder distributing section 2.

In addition to the above basic functional construction, the control unit 40 further comprises a valve abnormality detecting section 61, normal valve close commanding sections 62 and 72, valve recovery commanding sections 63 and 73, an opening and closing timing change commanding section 64, a fuel injection stop commanding section 65, a fuel correction stop commanding section 66, a basic fuel injection quantity change commanding section 67, an intake-air quantity correcting section 68, a power-apply stop commanding section 75, and an ignition retard commanding section 76.

More specifically, valve abnormality detecting section 61 decides according to a valve lift quantity L whether the valve operates normal. Normal valve close commanding sections 62 and 72 output the valve closing commands to normal valves when the abnormality of the valve is detected. Valve recovery commanding sections 63 and 73 executes a recovery operation of the abnormal valve. Opening and closing timing change commanding section 64 commands intake-valve opening and closing timing calculating section 47 to calculate the valve opening and closing timing so as to supply target intake-air quantity to each normal cylinder except for the abnormal cylinder when the valve abnormality is detected at one of the cylinders. Fuel injection stop commanding section 65 commands injector 13 of the abnormal cylinder to stop the fuel injection when the valve abnormality is detected. Fuel correction stop commanding section 66 commands fuel injection quantity correcting section 43 to stop the correction of basic fuel injection quantity Ta when exhaust valve 3 of one of the cylinders 9 is put in the abnormal condition. Basic fuel injection quantity change commanding section 67 commands basic fuel injection quantity calculating section 41 to calculate the basic fuel injection quantity for each cylinder on the precondition that the total intake are is supplied to the normal cylinders except for the abnormal cylinder when the valve abnormality is detected. Intake air quantity correcting section 68 corrects the intake air quantity detected by airflow meter 7 when the intake valve abnormality is detected. Power-apply stop commanding section 75 commands ignition timing cylinder distributing section 52 to stop the current-flowing to primary ignition coil 82 when the valve abnormality is detected. Ignition retard commanding section 76 commands ignition timing calculating section 51 to retard the ignition timing when the valve abnormality is detected and when the current-flowing to primary ignition coil 82 has been started.

The engine control system according to the present invention is basically constituted by valve abnormality detecting means which is constituted by lift quantity sensor 34 and valve abnormality detecting section 61, normal valve close controlling means which is constituted by normal valve close commanding sections 62 and 72 and cylinder distributing sections 49 and 59, current-flowing stop controlling means which is constituted by current-flowing stop commanding section 75 and ignition timing cylinder distributing section 52, ignition retard controlling means is constituted by ignition retard commanding section 76 and ignition timing cylinder distributing section 52, fuel injection stop controlling means which is constituted by fuel injection stop commanding section 65 and fuel injection quantity cylinder distributing section 44, intake valve controlling means which is constituted by intake valve opening and closing timing cylinder distributing section 49, and injector control means which is constituted by fuel injection quantity cylinder distributing section 44.

Next, the manner of operation of the engine system according to the embodiment of the present invention will be discussed.

First, the operation of the engine system, which operates normally, will be discussed with reference to FIG. 1.

Engine 1 is a four-cycle engine and therefore repeatedly executes intake stroke→compression stroke→explosion stroke→exhaust stroke. The operation of intake valve 2, the operation of exhaust valve 3, the operation of injection 13 and the operation of spark plug 16 are executed according to the combustion process of engine 1. Intake valve 2 is opened during a period from the second half of the exhaust stroke to a first half of the intake stroke. Exhaust valve 3 is opened during a period from a second half of the explosion stroke to the exhaust stroke, and is closed during a period from a second half of the exhaust stroke to a first half of the intake stroke. Injector 13 is turned on for a predetermined time during the exhaust stroke before the intake stroke to supply the fuel for one combustion cycle. The current-flowing to primary coil 82 of ignition coil 81 is started during the intake stroke and is terminated at an end of the compression stroke. When the current-flowing to primary coil 82 is shut off, the induction voltage is generated at secondary coil 83 and therefore spark plug 16 is ignited.

When electromagnetic coils 31 and 32 are disconnected (break of wire), or when the power to electromagnetic coils 31 and 32 is insufficient, the valve operation of intake and exhaust valves 2 and 3, which are of an electromagnetic drive type, is incomplete and is stopped at neutral position. Particularly, during the operation from the closing condition to the opening condition or the operation from the opening condition to the closing condition, intake and exhaust valves 2 and 3 tend to stop at the neutral position since the operation of the intake or exhaust valves 2, 3 is not properly executed due to the relationship between the selecting operation of coils 31 and 32 and the biasing force of coil springs 35 or other external force.

If the operation of engine 1 is continued without executing counteraction as to the above-described abnormal condition, the following events will occur.

Figure 15:
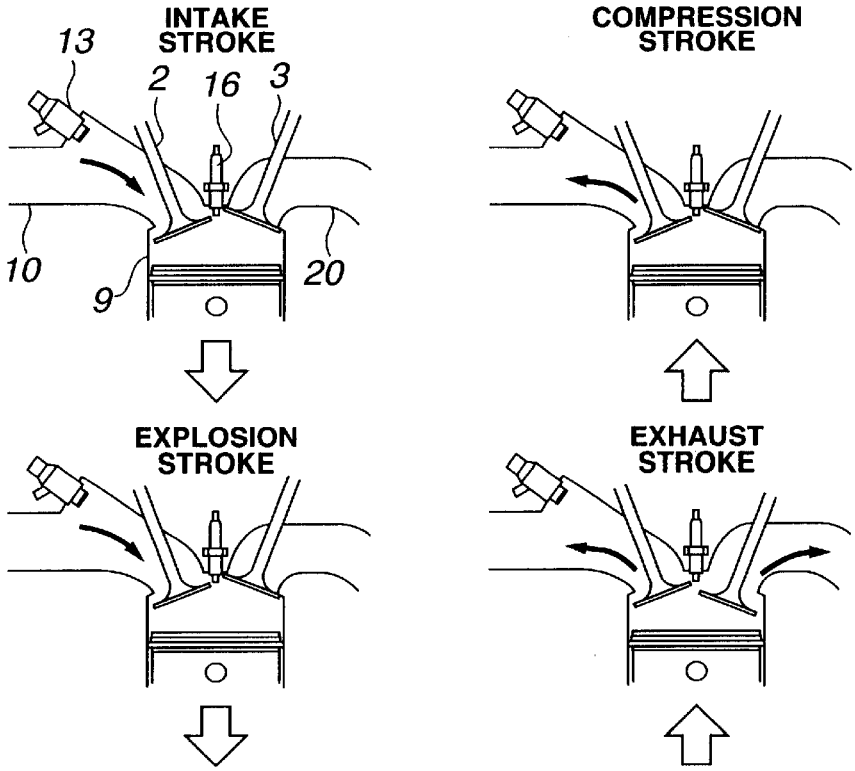
FIG. 15 is a view showing operating conditions of a cylinder having an abnormal intake valve in every stroke when no treatment is executed to the abnormality.
Figure 16:
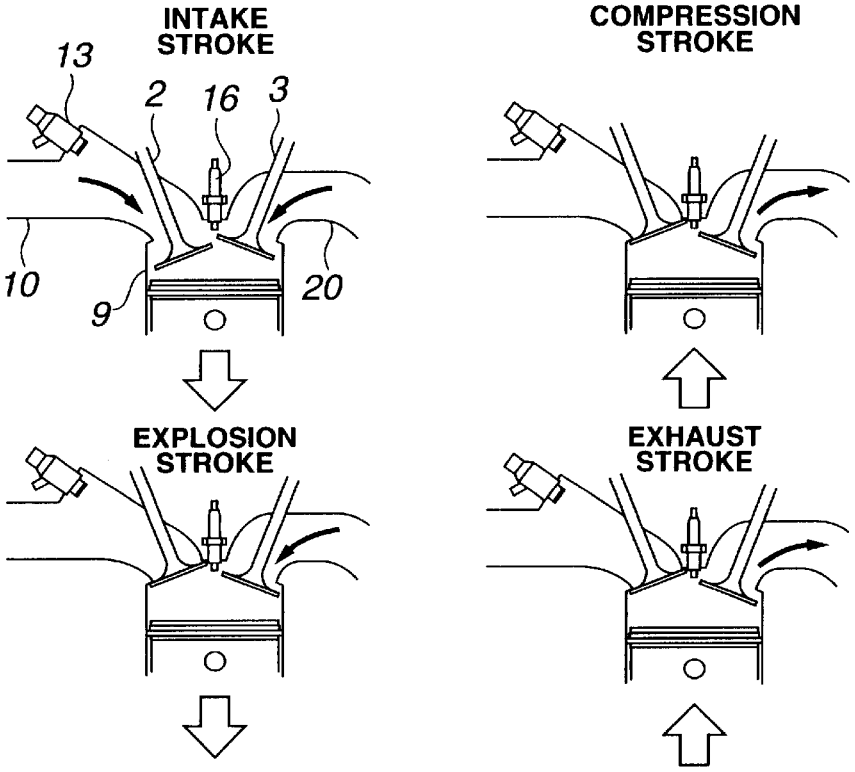
FIG. 16 is a view showing operating conditions of a cylinder having an abnormal exhaust valve in every stroke when no treatment is executed to the abnormality.
Figure 17:
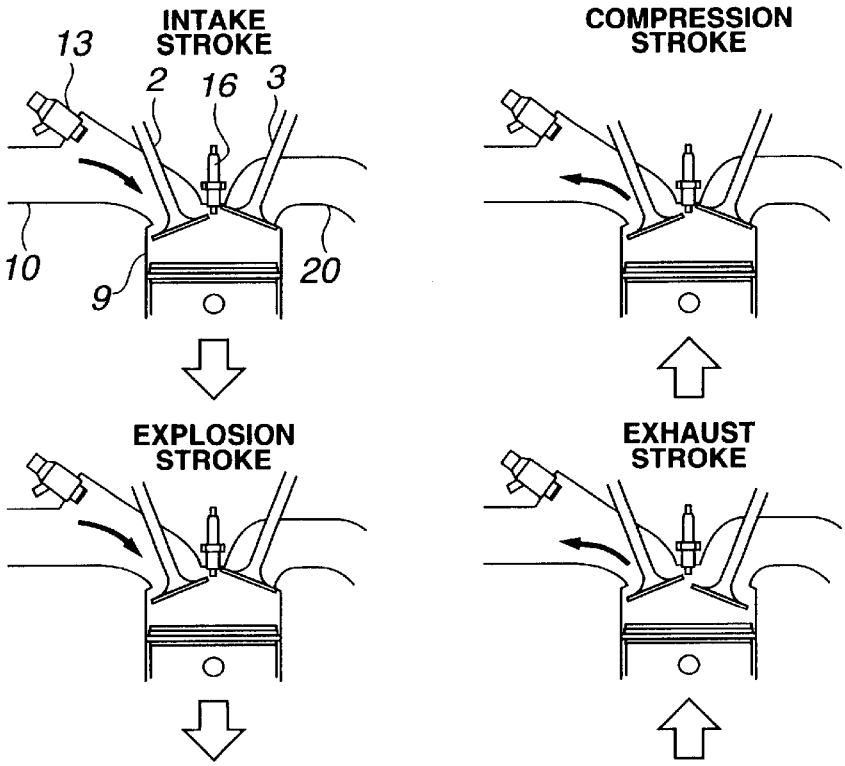
FIG. 17 is a view showing operating conditions of a cylinder having the abnormal intake valve in every stroke when a treatment according to the present invention is executed to the abnormality.
Figure 18:
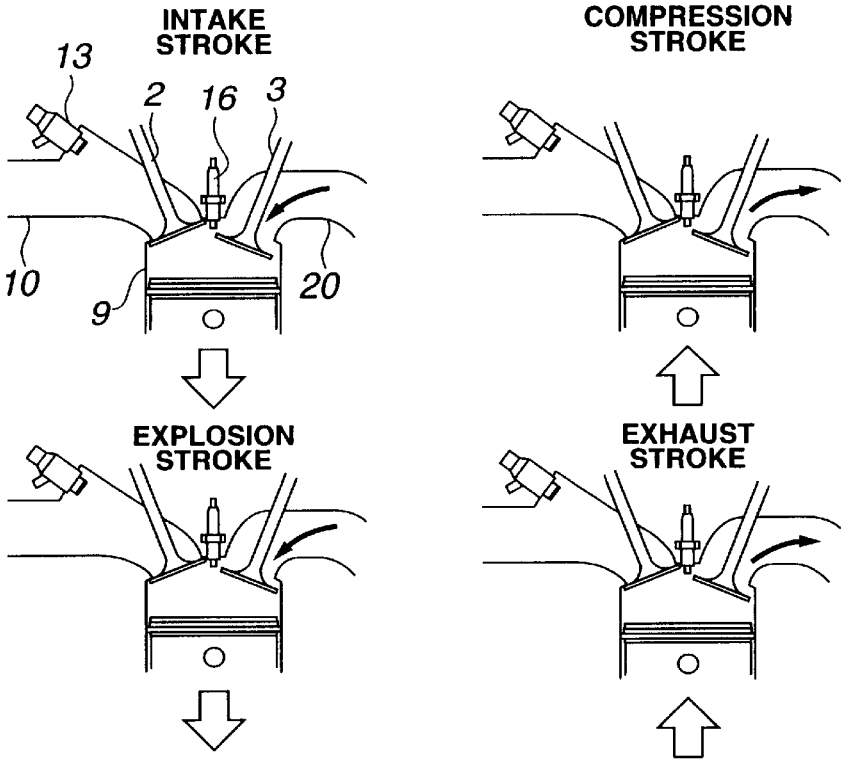
FIG. 18 is a view showing operating conditions of a cylinder having the abnormal exhaust valve in every stroke when a treatment according to the present invention is executed to the abnormality.

With reference to FIG. 15, there will be discussed the behavior of the system in case that no counteraction is executed with respect to the abnormality of intake valve 2. In FIGS. 16–18, a black arrow indicates a moving direction of gas, and a white arrow indicates a moving direction of a piston.

When intake valve 2 is stopped at the neutral position due to the abnormality of intake valve 2, during the intake stroke fuel and airflow into cylinder 9 through intake passage 10 according to the lowering of the piston. However, the lift quantity of intake valve 2 in abnormal condition is smaller than that in the normal condition, and therefore the intake air quantity is lowered as compared with that under the normal condition.

During the compression stroke, the air and fuel aspirated during the intake stroke is flowed inversely to the intake passage 10 according to the raising up of the piston. If the igniting operation is normally executed at the second half of the compression stroke, fuel in cylinder 9 is ignited and the flame transmitted to the fuel at the intake port. Therefore, the combustion of the fuel is also generated in the intake port. This phenomenon is called "backfire". If this backfire is generated in a big way, the pressure in the intake passage 10 becomes large and therefore parts in this portion may be degraded.

During the explosion stroke, since the compression stroke is not normal, the pushing-down force to the piston is small but the piston is pushed down. Due to this pushing down of the piston flows the gas in the intake port into cylinder 9.

During the exhaust stroke, the gas in cylinder 9 is moved and distributed to the intake port and the exhaust port according to the lift-up of the piston. Since the combustion in cylinder 9 was not normal, the gas flowing out cylinder 9 includes oxygen and fuel, and a part of them flows to exhaust passage 20 through the exhaust port. The oxygen and fuel reaches catalyst 21 and react with catalyst 21. This reaction generates heat and may degrade catalyst 21 thereby.

Next, there will be discussed the behavior in case that no counteraction is executed with respect to the abnormality of exhaust valve 3, with reference to FIG. 16.

During the intake stroke, gases flow into cylinder 9 through both the intake port and the exhaust port since exhaust valve 3 is not fully closed. The gas flowed into cylinder 9 includes fuel injected by injector 13.

During the compression stroke, the air and fuel flow from cylinder 9 to exhaust port. If the igniting operation is normally executed at the second half of the compression stroke, fuel in cylinder 9 is fired, and the flame thereof is transmitted to fuel in the exhaust port to generate combustion in exhaust passage 20. This phenomenon is called "after burn". If this after burn is generated in a big way, the pressure in exhaust passage 10 becomes large and therefore parts in this portion may be degraded.

During the explosion stroke, gas in exhaust port is returned to cylinder 9 according to the lowering of the piston.

During the exhaust stroke, the gas in cylinder 9 is moved to the exhaust port according to the lift-up of the piston. As is similar to the case of FIG. 15, the combustion in cylinder 9 was not normal. Therefore, the gas including oxygen and fuel flows to exhaust passage 20 through the exhaust port. The oxygen and fuel reach catalyst 21 and react with catalyst 21. This reaction generates heat and may degrade catalyst 21.

The above-described abnormal condition was simplified such that the valve 2, 3 is stopped at the neutral position, in order to smoothen the explanation. However, even when the abnormal condition is that the valve 2, 3 is not closed though it is intended to close the valve 2, 3, the phenomenon thereof is basically similar to that of the above-described condition in quantity.

Next, there will be discussed the operation of the engine system put in the various conditions in that one of intake and exhaust valves 2 and 3 becomes abnormal, with reference to FIGS. 11–13, 17 and 18.

Figure 11:
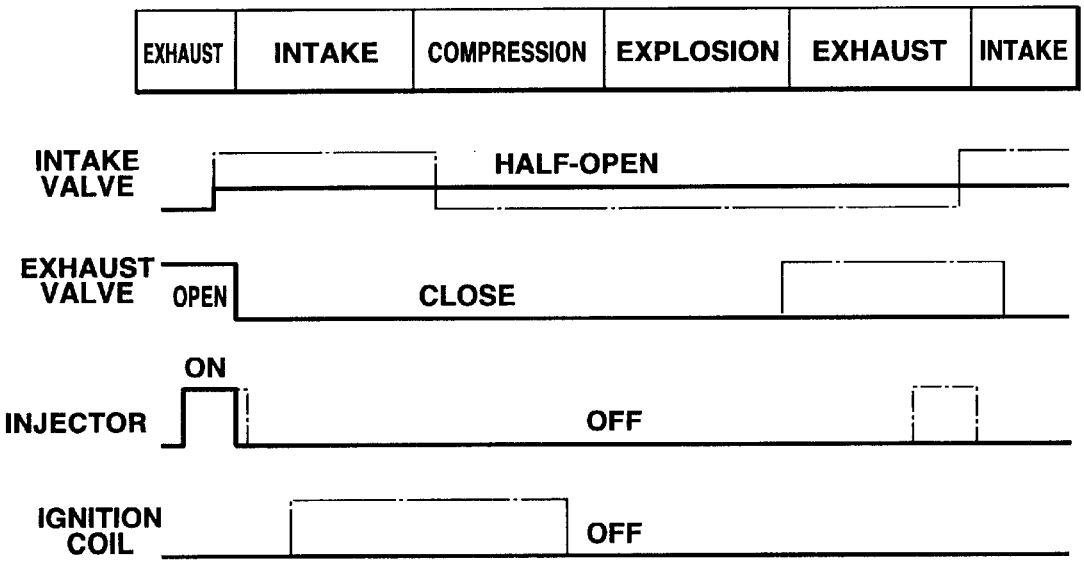
FIG. 11 is a time chart showing operating conditions of main parts in every stroke under an intake valve abnormal condition caused at the transition from the closing condition to the opening condition.

With reference to FIGS. 11 and 17, there will be discussed an abnormal condition where intake valve 2 becomes abnormal at the transition from the closing condition to the opening condition.

When intake valve 2 of a specific cylinder becomes abnormal, valve abnormality detecting section 61 detects abnormality of output value L detected by lift quantity sensor 34 of intake valve 2 of the specific cylinder. Valve abnormality detecting section 61 quickly informs the abnormality of intake valve 2 of the specific cylinder to fuel injection stop commanding section 65, normal valve closing commanding sections 62 and 72, current-flowing stop commanding section 75, ignition delay commanding section 76. Fuel injection stop commanding section 65 stops fuel injection of injector 13 of the specific cylinder through fuel injection quantity cylinder distributing section 44. Normal valve close commanding section 62 for intake valve 2 executes no operation since intake valve 2 became abnormal. On the other hand, normal close commanding section 72 for exhaust valve 3 commands exhaust valve 3 of the specific cylinder to close. Current-flowing stop commanding section 75 stops the current-flowing to primary ignition coil 82 of the specific cylinder. Ignition delay commanding section 76 executes no operation since the current-flowing to primary ignition coil 82 has not been started yet.

That is, as shown in FIG. 11, when the abnormal condition is generated at the transition from the closing to opening of intake valve 2 of the specific cylinder, the fuel injection of the operating injector 14 is stopped, and the current-flowing to primary ignition coil 82 during the intake stroke is stopped. Further, opening operation of exhaust valve 3 of the specific cylinder to be opened at the second half of the explosion stroke is stopped.

As a result, as shown in FIG. 17, when the abnormality is generated at the transition from the closing to opening of intake valve in the second half of the exhaust stroke, part of exhaust gas inversely flows to intake passage 10 through half-open intake valve 2. During the intake stroke, fuel whose quantity is smaller than an initial intent quantity and inversely flowed exhaust gas and intake air to intake passage 10 flow into cylinder 9. During the compression stroke, the piston lifts up, and therefore the fuel, the intake air and the exhaust gas flow inversely to intake passage 10 through the half-open intake valve 2. Since spark plug 16 is not ignited, the fuel in cylinder 9 and intake passage 10 is not combusted. Then, during the explosion stroke, the piston moves down due to its inertia, and the fuel, intake air and exhaust gas again flow into cylinder 9. During the exhaust stroke, since exhaust valve 3 is not opened, the fuel, intake air, and the exhaust gas again inversely flow to intake passage 10. Hereinafter, according to the moving up and down of the piston, the fuel, the intake air, and the exhaust gas reciprocatingly moves between cylinder 9 and intake passage 9.

That is, even if the abnormal condition is generated at the transition from closing to opening of intake valve 2 of the specific cylinder. This arrangement prevents the generation of backfire. Further, since exhaust valve 3 is closed in reply to the generation of abnormal condition at intake valve 2 of the specific cylinder, the flowing of the gas to the exhaust passage 20 is prevented and therefore the catalyst is prevented from being degraded thermally.

Next, with reference to FIGS. 12 and 17, there will be discussed an abnormal condition where intake valve 2 becomes abnormal at the transition from opening condition and the closing condition during the first half of the compression stroke.

When intake valve 2 of a specific cylinder becomes abnormal, valve abnormality detecting section 61 detects abnormality of output value L detected by lift quantity sensor 34 of intake valve 2 of the specific cylinder. Valve abnormality detecting section 61 quickly informs the abnormality of intake valve 2 of the specific cylinder to fuel injection stop commanding section 65, normal valve closing commanding sections 62 and 72, current-flowing stop commanding section 75, ignition delay commanding section 76. Fuel injection stop commanding section 65 stops fuel injection of injector 13 of the specific cylinder through fuel injection quantity cylinder distributing section 44. Normal valve close commanding section 72 for exhaust valve 3 commands exhaust valve 3 of the specific cylinder to maintain the closing condition. Current-flowing stop commanding section 75 does not stop the current-flowing to primary ignition coil 82 of the specific cylinder in this stroke since the current-flowing to primary ignition coil 82 of the specific cylinder 9 has already started. Current-flowing stop commanding section 75 stops the current-flowing in the next combustion stroke. Ignition delay commanding section 76 elongates a time period for the current-flowing and stops the current-flowing at the second half of the explosion stroke to ignite at the second half of the explosion stroke since the current-flowing to primary ignition coil 82 has already been started.

Figure 12:
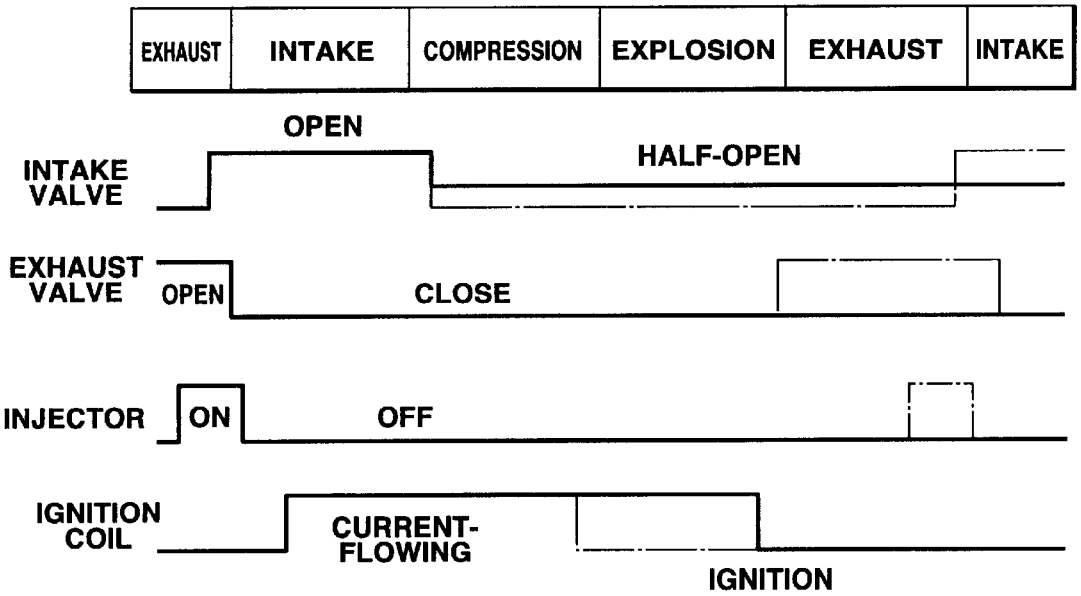
FIG. 12 is a time chart showing operating conditions of main parts in every stroke under the intake valve abnormal condition caused at the transition from the opening condition to the closing condition.

That is, as shown in FIG. 12, when the abnormal condition is generated at the transition from the opening condition to the closing condition of intake valve 2 of the specific cylinder during the first half of the compression stroke, the fuel injection to the specific cylinder is stopped at the next combustion cycle, and opening operation of exhaust valve 3 of the specific cylinder to be opened at the second half of the explosion stroke is stopped. Further, the current-flowing to primary ignition coil 82, which is now being executed, is elongated in time period and is stopped at the second half of the explosion stroke.

As a result, when the abnormality is generated at the transition from the closing condition to opening condition of intake valve 2 of the specific cylinder in the first half of the exhaust stroke, intake air and fuel are inversely flow to intake passage 10 through half-open intake valve 2 as shown in FIG. 17.

During the second half of the explosion stroke, the ignition is not executed, and the combustion cycle proceeds to the explosion stroke. During the explosion stroke, the piston moves down due to its inertia, and the fuel and the intake air in intake passage 10 flow into cylinder 9. At the second half of the explosion stroke, that is, when the volume of the combustion chamber is increasing due to moving down of the piston, the current-flowing to primary ignition coil 82 is stopped to ignite spark plug 16. Since the volume of the combustion chamber is large as compared with that at the normal ignition time, the fuel density in the combustion chamber is low and therefore the combustion therein becomes mild. This mild combustion is different from the violent combustion like as explosion. Therefore, the tendency of generating backfire becomes small, and even if it is generated, the magnitude thereof will small.

Basically, when intake valve 2 becomes abnormal at the timing that fuel has been already injected into cylinder 9, it is preferable to stop (cancel) the ignition in cylinder 9. However, when the current-flowing to primary ignition coil 82 has been already started, it is not preferable to continue the current-flowing to primary ignition coil 82 for the purpose of preventing the ignition during the explosion stroke. That is, this continuation of the current-flowing will heat and degrade primary ignition coil 82 and drive circuit 80. Therefore, it is necessary to ignite spark plug 16 at any timing by shutting off the current-flowing to primary ignition coil 82 if the current-flowing to primary ignition coil 82 is once started. Accordingly, the engine system according to the present invention is arranged to ignite spark plug 16 at the second half of the explosion stroke where the fuel density becomes minimum so as to suppress the damage due to the ignition at minimal.

During the exhaust stroke, exhaust valve 3 is closed. Therefore, the exhaust gas in cylinder 9 inversely flows to intake passage 10 through half-open intake valve 2 according to the moving up of the piston. The fuel injected at the second half of the exhaust stroke is flows into cylinder 9 together with the exhaust gas in intake passage 10. In the later intake stroke after the present intake stroke, the current-flowing to primary ignition coil 82 is not executed. Accordingly, thereafter, the intake air and the exhaust gas reciprocatingly move cylinder 9 and intake passage 10.

Accordingly, even if the abnormality of intake valve 2 of the specific cylinder is generated at the transition from the closing condition to the opening condition during the first half of the compression stroke, where fuel injection has been already finished and the current-flowing to primary ignition coil 82 has been already started, the backfire tends not to generate. If it were generated, the size of the backfire becomes very small. Further, since exhaust valve 3 is kept at the closing condition, the gas in cylinder does not flow to the catalyst. Therefore, this arrangement according to the present invention prevents the catalyst from being degraded by heat.

Next, with reference to FIGS. 13 and 18, there will be discussed an abnormal condition where exhaust valve 3 becomes abnormal at the transition from opening condition to the closing condition at a start of the intake stroke.

When exhaust valve 2 of a specific cylinder becomes abnormal, valve abnormality detecting section 61 detects abnormality of output value L detected by lift quantity sensor 34 for exhaust valve 3 of the specific cylinder. Valve abnormality detecting section 61 quickly informs the abnormality of exhaust valve 3 of the specific cylinder to fuel injection stop commanding section 65, normal valve close commanding sections 62 and 72, current-flowing stop commanding section 75, and ignition delay commanding section 76. Fuel injection stop commanding section 65 stops fuel injection of injector 13 of the specific cylinder through fuel injection quantity cylinder distributing section 44. Normal valve close commanding section 72 for exhaust valve 3 of the specific cylinder executes no operation. Normal valve close commanding section 62 for intake valve 2 of the specific cylinder commands intake valve 2 to be put in the closing condition. Current-flowing stop commanding section 75 stops the current-flowing to primary ignition coil 82 of the specific cylinder. Ignition delay commanding section 70 executes no operation since the current-flowing to primary ignition coil 82 is not started.

Figure 13:
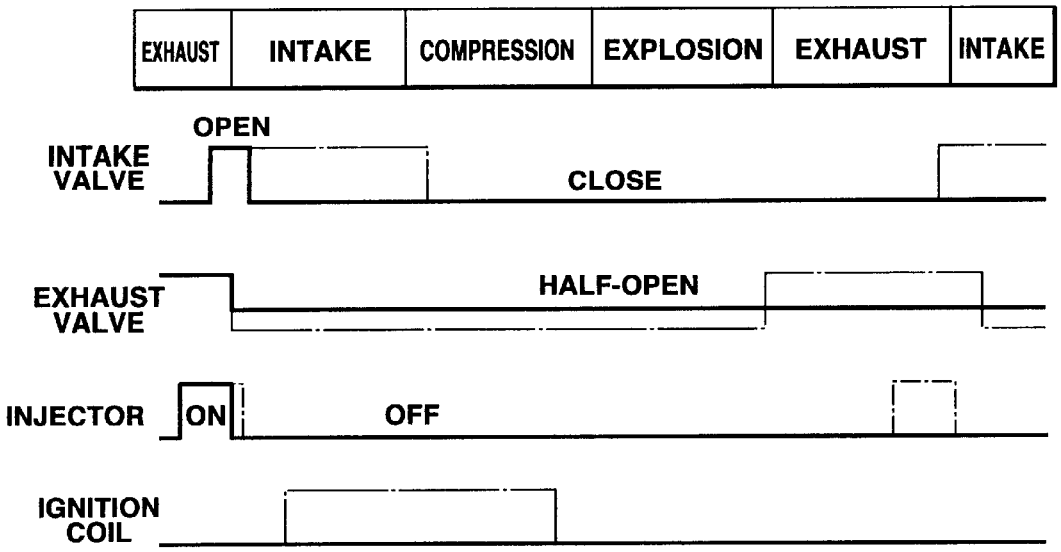
FIG. 13 is a time chart showing operating conditions of main parts in every stroke under an exhaust valve abnormal condition caused at the transition from the opening condition to the closing condition.

That is, as shown in FIG. 13, when the abnormal condition is generated at the transition from the opening condition to the closing condition of exhaust valve 3 of the specific cylinder, the fuel injection to the specific cylinder is stopped, and intake valve 2 set at the opening condition is closed. Further, the current-flowing to primary ignition coil 82 during the intake stroke is stopped.

As a result, when the abnormality is generated at the transition from the closing condition to the opening condition of exhaust valve 3 of the specific cylinder in the start of the exhaust stroke as shown in FIG. 18, the fuel injected at the last of the previous exhaust stroke and intake air flow into the specific cylinder 9. Since intake passage 10 of the specific cylinder 9 is quickly closed, the flowed quantity of fuel and intake air becomes small. During the intake stroke, since exhaust valve 3 is put in the half-open condition, part of the exhaust gas flows into cylinder 9 through the half-open exhaust valve 3. That is, during this intake stroke, the exhaust gas and slight fuel and air flow into specific cylinder 9. Since intake valve 2 is put in the closed condition during the intake stroke, the fuel for the specific cylinder 9 cannot flow into the specific cylinder 9 and retains in the intake port. The retained fuel is gradually dispersed and flows into other cylinders and combusts. During the compression stroke, the exhaust gas, the slight fuel and air flow to exhaust passage 20. During the second half of this compression stroke, the ignition of spark plug 16 is not executed. During the explosion stroke, the gas in exhaust passage 20 inversely flows to cylinder 9. Thereafter, the intake air and the exhaust gas reciprocatingly move cylinder 9 and intake passage 10.

Accordingly, even if the abnormality of exhaust valve 3 of the specific cylinder is generated at the transition from the opening condition to the closing condition at the start of the intake stroke, almost zero of the fuel flows into the specific cylinder 9, and spark plug 16 is not ignited. Therefore, the after-burn will be prevented though exhaust valve 3 is put in the half-open condition.

Figure 14:
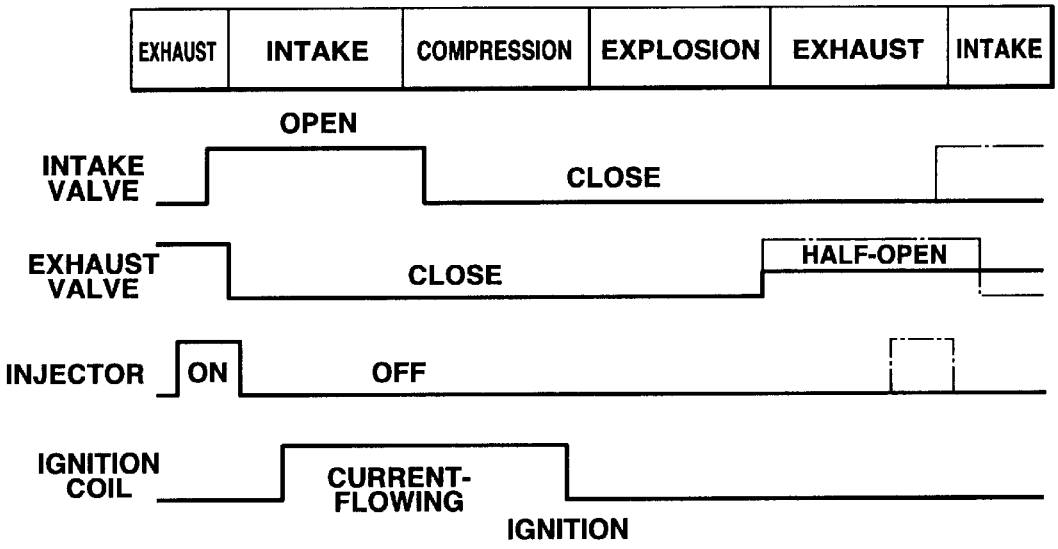
FIG. 14 is a time chart showing operating conditions of main parts in every stroke under the exhaust valve abnormal condition caused at the transition from the opening condition to the closing condition.

Next, with reference to FIGS. 14 and 18, there will be discussed an abnormal condition where exhaust valve 3 becomes abnormal at the transition from the closing condition to the opening condition at an end of the explosion stroke.

When exhaust valve 2 of a specific cylinder becomes abnormal, valve abnormality detecting section 61 detects abnormality of output value L detected by lift quantity sensor 34 for exhaust valve 3 of the specific cylinder. Valve abnormality detecting section 61 quickly informs the abnormality of exhaust valve 3 of the specific cylinder to fuel injection stop commanding section 65, normal valve close commanding sections 62 and 72, current-flowing stop commanding section 75, and ignition delay commanding section 76. Fuel injection stop commanding section 65 stops fuel injection of injector 13 of the specific cylinder through fuel injection quantity cylinder distributing section 44. Normal valve close commanding section 62 for intake valve 2 of the specific cylinder prevents intake valve 2 of the specific cylinder from being opened. Current-flowing stop commanding section 75 stops the current-flowing to primary ignition coil 82 of the specific cylinder since the current-flowing to primary ignition coil 82 is not started yet.

As a result, during the exhaust stroke, the exhaust gas in the specific cylinder 9 is flowed to exhaust passage 20 through the half-open exhaust valve 3, as shown in FIG. 18. During a period from the second half of the present exhaust stroke to the next intake stroke in the next combustion cylinder, the fuel injection is stopped, and intake valve 2 is kept at the closed condition. Therefore, the fuel is not flowed into the specific cylinder 9, and the exhaust gas is inversely flowed into the specific cylinder 9 through the half-open exhaust valve 3. Thereafter, the exhaust gas reciprocatingly moves cylinder 9 and exhaust passage 20. Both the fuel injection and the ignition of spark plug for the specific cylinder are not executed.

Accordingly, even if the abnormality of exhaust valve 3 of the specific cylinder is generated at the transition from the closing condition to the opening condition at the end of the explosion stroke, the fuel injection and the ignition of spark plug 16 for the specific cylinder 9 are stopped. Therefore, exhaust passage 20 and intake passage 10 are protected from being damaged.

As explained in the above, the engine system according to the present invention is arranged so that ignition coil 16 is not ignited when the current-flowing to primary ignition coil 82 is not started and even when either of intake valve 2 or exhaust valve 3 is put into the abnormal condition at the transition of combustion cycle. Therefore, parts in intake passage 10 or parts in exhaust passage 20 are protected from being degraded by backfire or after-burn. Further, even when the current-flowing to primary ignition coil 82 has started during the transition process of either intake valve 2 or exhaust valve 3, the ignition of spark plug 16 is executed at the timing that the fuel density is minimum. This suppresses the damage to parts of intake passage 10 or exhaust passage 20 at minimum.

Although the explanation was made as to the abnormal condition of intake valve 2 or exhaust valve 3 at the transition process, the same result is generated when either intake valve 2 or exhaust valve 3 becomes abnormal at an opening condition or closing condition. That is, even if either intake valve 2 or exhaust valve 3 becomes abnormal at the opening condition or closing condition, the damage to parts in intake passage 10 or catalyst in exhaust passage 20 is prevented.

Further, the above-explanation has been made as to the abnormal condition where intake valve 2 or exhaust valve 3 is stayed at the half-open condition. However, even if the abnormal condition is that intake valve 2 or exhaust valve 3 is stayed at full closing condition, the operations to be done are basically the same as mentioned above although the quantity of gas reciprocatedly moving between cylinder 9 and intake passage 10 increases. Further, even if the abnormal condition of intake valve 2 is an incomplete closing condition, such that the intake valve becomes abnormal at the transition from the closing condition to the opening condition, the operations to be done are basically the same as mentioned above although the quantity of gas does not move between cylinder 9 and intake passage 10. That is, even if the abnormal condition of valve 2 or 3 is a full closing condition, a half-open condition or full opening condition, the arrangement according to the present invention prevents the parts in intake passage 10 or exhaust passage 20 from being degraded.

Figure 19:
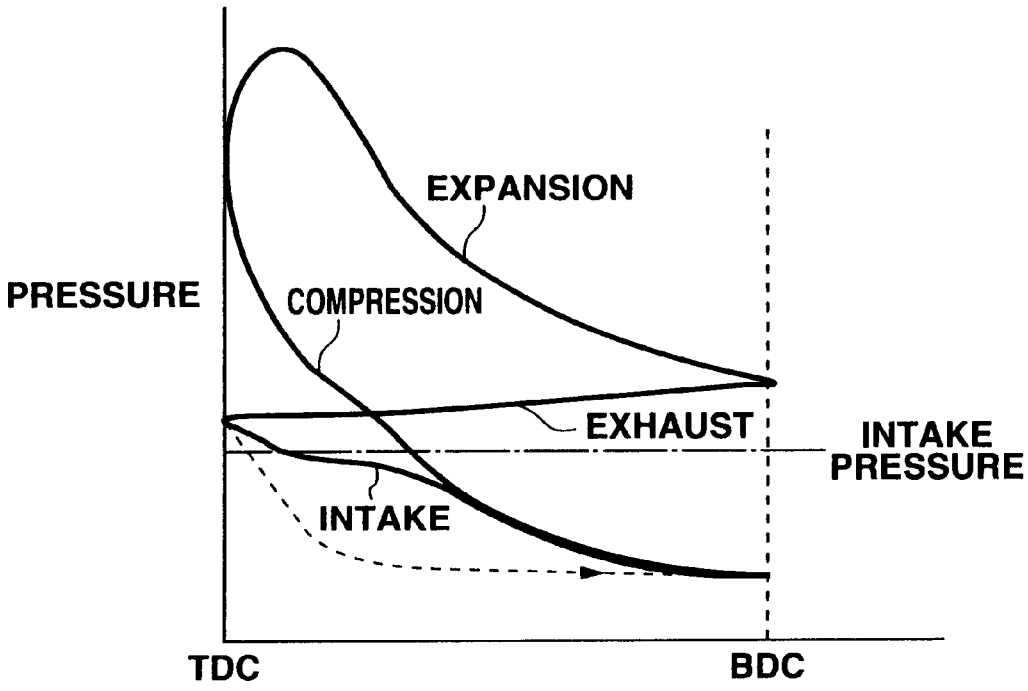
FIG. 19 is a graph showing a change of in-cylinder pressure of a four-cycle engine.

Next, the gas behavior in cylinder will be discussed with reference to FIGS. 19 and 20. First, the gas behavior in the normally operating cylinder will be discussed with reference to FIG. 19.

During the intake stroke, the pressure in intake passage 10 is put in a vacuum condition as compared with the atmospheric pressure. The pressure in cylinder 9 becomes generally the same as that in intake passage 10 during the opening condition of intake valve 2. From the closing of intake valve 2, the pressure in cylinder 9 transits to the characteristic of a conventional intake stroke. In reply to the transition to the compression stroke, the intake air is compressed, and therefore the pressure in cylinder 9 increases. Then, at a predetermined timing, the ignition to the mixture of air and fuel in cylinder is executed by the spark plug. By the generation of heat, combustion gas starts expanding, and therefore the pressure in cylinder further increases. During this process, the stroke of combustion cylinder moves to the expansion stroke, and this high pressure works to push down the piston. During the next exhaust stroke, exhaust valve 3 is opened, and therefore the combustion gas is discharged and the pressure in cylinder 9 varies to a value near the pressure in exhaust passage 20.

Considering as to external work of the engine, the work quantity of the engine is an integral of pressure characteristic. During the intake and compression strokes, the negative work executed by a conventional camshaft type engine is greater than that of the electromagnetically operated valve employed engine. The pressure characteristic curve during the intake stroke is shown by a broken line in FIG. 19. That is, pumping loss of the engine is decreased by optimizing the valve closing timing of intake valve through the operation of the electromagnetically operated valve. Therefore, the electromagnetically operated valve employed engine improves the fuel consumption during the intake stroke as compared with the conventional intake stroke. This is one of advantages of the electromagnetic operated valve equipped engine.

Figure 20:
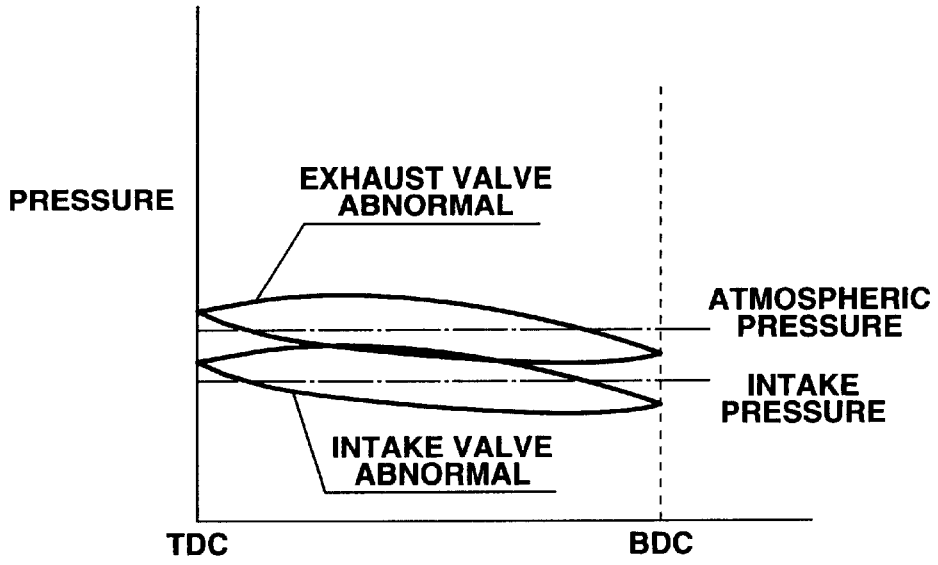
FIG. 20 is a graph showing the change of the in-cylinder pressure in case that intake or exhaust valve is put in the abnormal condition.

FIG. 20 shows the behavior of cylinder pressure during the abnormal condition of intake and exhaust valves 2 and 3. During the abnormality of intake valve 2, the gas repeatedly moves between the intake port and the cylinder. During the abnormality of exhaust valve 3, the gas repeatedly moves between the exhaust passage and the cylinder. As a result, the cylinder pressure repeatedly deviates from the center of the pressure under the valve opening condition with a hysteresis due to the flow resistance of valve.

Accordingly, from the macroscopic viewpoint, the specific cylinder put in the abnormal condition generates no static gas-flow at the intake passage and the exhaust passage. The microscopic movement of gas between cycles is only caused. That is, the specific cylinder put in the abnormal condition may be eliminated from the total operation of the engine in view of the intake and exhaust operation of the gas. Therefore, it is preferable that the engine control under the abnormal condition is differentiated from that under the normal condition.

The engine control system according to the present invention is arranged to generate an engine output under the normal condition even if one of four cylinders is put in the abnormal condition and is eliminated from the substantial operation.

More specifically, as shown in FIG. 4, when it is decided that a valve of one of the four cylinders is put in the abnormal condition, basic fuel injection quantity change commanding section 67 commands basic fuel injection quantity calculating section 41 to determine the fuel injection quantity for each of normal cylinders so as to distribute the fuel only to the normal cylinders except for the abnormal cylinder. That is, when one cylinder is put in the abnormal condition, it is considered that the intake air is distributed to the remaining three cylinders. More specifically, intake air quantity Qa detected by airflow meter 7 is divided by engine speed N and 3 meaning the number of normal cylinders to obtain the basic fuel injection quantity per one cylinder (Qa/N/3).

Further, simultaneously with this calculation, opening and closing timing change commanding section 64 commands intake-valve opening and closing timing calculating section 47 to determine the valve closing timing so as to distribute the target intake air quantity Qt to the normal cylinders except for the abnormal cylinder. More specifically, by retarding the valve closing timing, the intake air quantity per cylinder is increased to ⅔ time of a normal quantity.

By this processing, engine 1 generates the engine output generally similar to that under the normal condition according to the accelerator depression even if only three cylinders of engine 1 are substantially operating due to the abnormality of one cylinder. Under this operation, the driver cannot sense that one cylinder of the engine is put into the abnormal condition. Therefore, it is preferable to inform the generation of the abnormality at the valve of the specific cylinder to the driver.

Further, it is possible to take another way for the trouble-shooting. For example, the engine control system may be arranged so that the driver can sense the engine is put in the abnormal condition. That is, opening and closing timing change commanding section 64 does not command intake-valve opening and closing timing calculating section 47 specifically so that the engine output is lowered to ¾ times of the output under the normal condition by maintaining the intake air quantity per cylinder and the fuel injection quantity per cylinder. Under this operation, if the engine is controlled under idling condition and at an initially-set target intake-air quantity, the engine speed becomes unstable and may be stalled due to the lowering of the actual engine output. Therefore, under this operation, an idling target intake-air quantity changing section 79 of control unit 40 commands target intake-air quantity calculating section 45 to increase the target intake-air quantity during idling so that the engine speed during idling is increased.

Further, in some cases, parameters corresponding to an engine output or throttle opening are required for the operation of an automatic transmission control apparatus, a vehicle attitude control system or a drive system equipped with an electric drive motor for a hybrid vehicle. Accordingly, when the engine system is put in an abnormal condition, the engine output is decreased by an output of the abnormal cylinder. Consequently, it is necessary to decrease the engine output valve outputted from the engine control unit or corresponding valves thereto by subtracting the output of the abnormal cylinder from the output of the normal condition engine.

Next, there will be discussed a further processing for the abnormality of intake valve 2 in accordance with the present invention.

Figure 21:
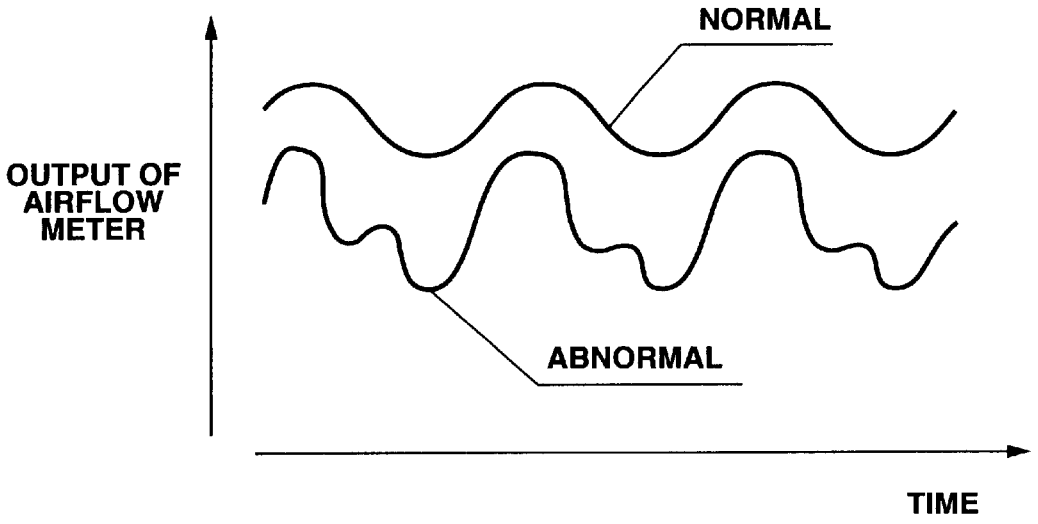
FIG. 21 is a graph showing an output characteristic of an airflow meter under a normal condition and an intake valve abnormal condition.

When intake valve 2 is put in the abnormal condition, as described above, the gas flow between the abnormal cylinder and the intake passage 10 is repeated in microscopic viewpoint. Therefore, the intake air quantity measured by airflow meter 7 includes the pulsation flow which is caused by the abnormality of the intake valve 2 of the specific cylinder, as shown in FIG. 21.

The waveform of the pulsation flow varies according to the engine speed, and complex phenomena including the reflection and resonance due to the shape of intake passage. Under this abnormal condition, it is necessary to execute another processing of the airflow meter output signal together with the above-mentioned fuel-injection quantity calculation for the abnormal cylinder.

According to the present invention, the control unit 40 comprises an intake air quantity correcting section 68 which operates in reply to the command from the valve abnormality detecting section 61, when intake valve 2 is put in the abnormal condition. Intake air quantity correcting section 68 processes the output signals of airflow meter 7 for a predetermined time period by means of the weighted average process using a relatively large time-constant. This time-constant may be determined from an output characteristic of airflow meter 7 during the abnormal condition of intake valve at a specific cylinder. In this case, such an output characteristic has been previously obtained by experiments. The time-constant may be theoretically determined taking account of the measurement principle and responsibility of the airflow meter and the shape of the intake passage.

When the intake valve 2 is put in the abnormal condition, the intake passage pressure also pulsates as is similar to the output of the airflow meter. Accordingly, controls depending on the intake passage pressure such as a purge control of a charcoal canister should be also executed according to the behavior of the intake passage pressure during the abnormal condition. More specifically, by determining a purge valve opening area for ensuring a target purging gas quantity from the charcoal canister according to the intake passage pressure during the abnormal condition, it becomes possible to ensure the target purging gas quantity. Furthermore, it is preferable to properly set the purge valve opening area upon taking account of the whole construction of the canister purging system. For example, when the intake valve 2 is put in the abnormal condition, the intake passage pressure may be estimated according to the actual condition of the abnormality, or the purging of the charcoal canister may be stopped.

When the fuel injection quantity calculation executes a correction based on a fuel pressure difference between upstream and downstream of injector 12, the desired fuel injection quantity is obtained by executing the correction according to the intake passage pressure during the abnormal condition. More specifically, when the intake valve 2 is put in the abnormal condition, the intake passage pressure estimate may be estimated according to the actual condition of the abnormality.

Next, there will be discussed the further processing executed during the abnormal condition of the exhaust valve 3, in accordance with the present invention.

When the exhaust valve 3 is put in the abnormal condition, as described above, the gas flow between the abnormal cylinder and the exhaust passage 20 is repeated in microscopic viewpoint. Therefore, a specific gas flow, which is different from that during the normal condition, is generated. In the embodiment according to the present invention, as shown in FIG. 1, A/F sensor 22 is disposed at the collector portion of the exhaust ports of cylinders 9 so as to receive the exhaust gases of the respective cylinders 9 sequentially when the engine operates normally. That is, the control unit 40 is arranged to detect the property of the exhaust gas of the intended cylinder 9 by sampling the output of A/F sensor 22 synchronized with the crankshaft angle. Accordingly, when exhaust valve 3 is put in the abnormal condition and if the output of A/F sensor 22 under the abnormal condition is processed as same as that under the normal condition, it becomes impossible to detect the property of the exhaust gas in the intended cylinder 9. Therefore, it is preferable not to execute another control based on the output of A/F sensor 22 when the exhaust valve 3 is put in the abnormal condition. More specifically, when exhaust valve 3 of the specific cylinder 9 is put in the abnormal condition, a fuel correction stopping commanding section 66 of control unit 40 operates according to the command from valve abnormality detecting section 61. Further, fuel correction stopping commanding section 66 commands fuel injection correcting section 43 to stop the correction of the basic fuel injection quantity Ta. That is, the air-fuel ratio feedback control is stopped, when the exhaust valve 3 is put in the abnormal condition.

Although the processing executed when the abnormality of intake valve 2 or exhaust valve 3 has been explained hereinabove, it will be understood that when the abnormal condition is turned to the normal condition, the processing is returned to the processing under the normal condition by executing the recovery operation. The recovery operation is the initializing operation discussed in the explanation of FIG. 9. For example, when intake or exhaust valve 2, 3 is put in the abnormal condition due to the mechanical trouble or electrical short-cut, the valve can not be returned to the normal condition even if the recovery operation is executed. On the other hand, when the abnormality of the valve 2, 3 is caused by a temporal voltage lowering or a mismatch of switching timings between valve opening and closing coils 31 and 32, the abnormal condition of the valve 2, 3 is returned to the normal condition by executing the initializing operation. Accordingly, control unit 40 comprises recovery commanding sections 63 and 73 as shown in FIG. 4.

Figure 22:
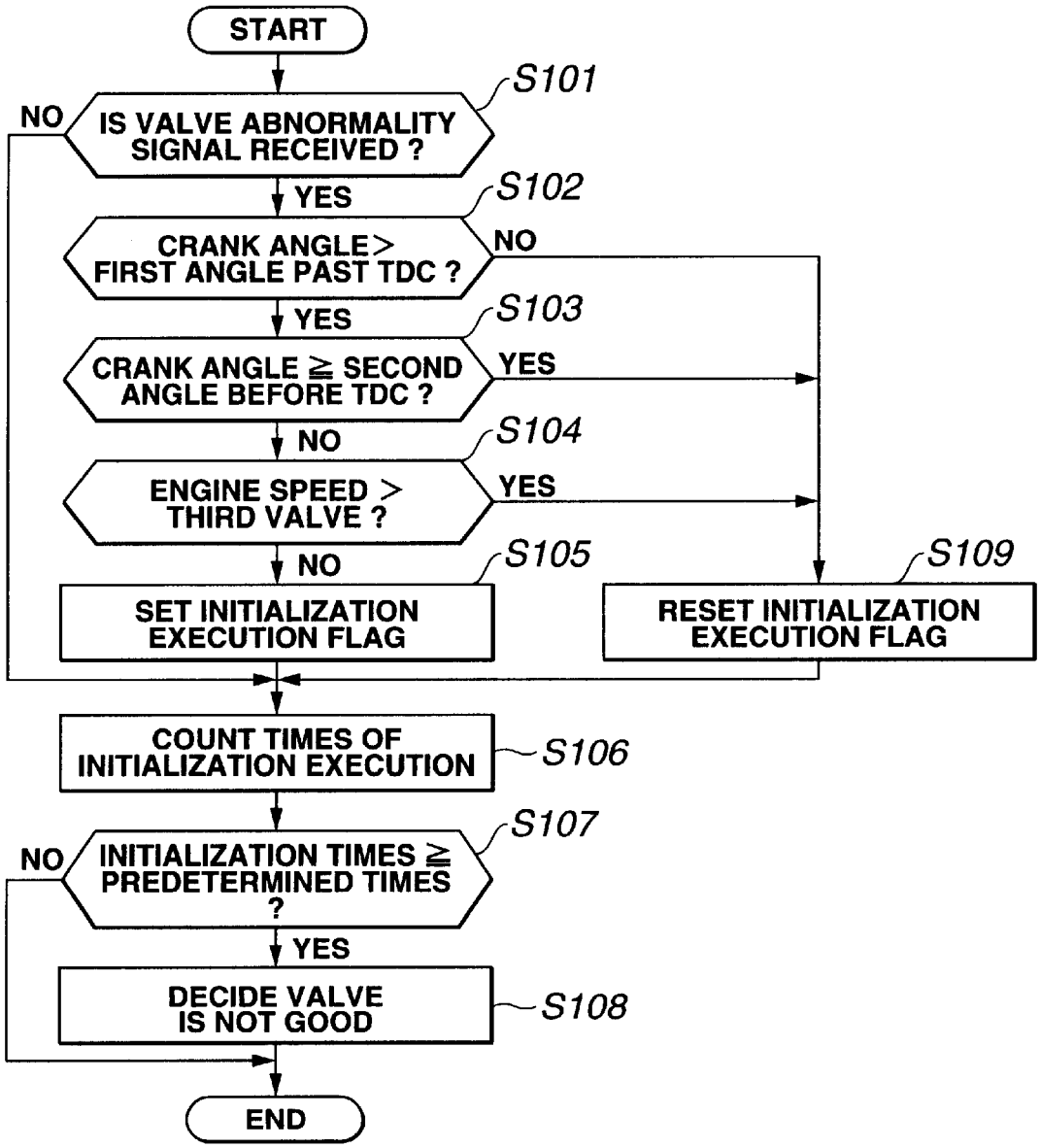
FIG. 22 is a flowchart showing a procedure of an initialization execution deciding process according to the present invention.
Figure 23:
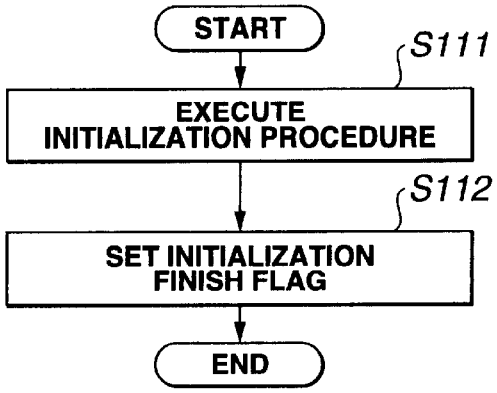
FIG. 23 is a flowchart showing a procedure of an initialization execution process according to the present invention.

With reference to flowcharts shown in FIGS. 22 and 23, there will be discussed the operation of recovery commanding sections 63 and 73, which correspond to the processing for executing the initialization operation. This processing is executed at predetermined time intervals so as to ensure its function.

At step S101, control unit 40 decides whether or not the valve abnormal indicative signal a is generated at valve abnormality detecting section 61. When the decision at step S101 is negative, that is, when valve abnormality detecting section 61 does not generates the valve abnormality indicative signal a, the routine jumps to step S106. When the decision at step S101 is affirmative, the routine proceeds to step S102 to execute the decision whether or no it is possible to actually execute the initialization operation.

At step S102, control unit 40 decides whether the crank angle is greater than a first predetermined angle past TDC (top dead center) in intake stroke or explosion stroke. When the decision at step S102 is negative, the routine proceeds to step S109. When the decision at step S102 is affirmative, the routine proceeds to step S103.

At step S103, control unit 40 decides whether the crank angle is greater than or equal to a second predetermined angle before TDC. When the decision at step S103 is affirmative, the routine proceeds to step S109. When the decision at step S103 is negative, the routine proceeds to step S104.

At step S104, control unit 40 decides whether or not engine speed N is greater than or equal to a third predetermined value. When the decision at step S104 is affirmative, the routine proceeds to step S109. When the decision at step S104 is negative, the routine proceeds to step S105.

At step S105, control unit 40 sets an initialization execution flag since control unit 40 decides that it is possible to execute the initialization process.

At step S109 following to the negative decision at step S102 or the affirmative decision at step S103 or S104, control unit 40 resets the initialization execution flag.

At step S106 following the execution of step S105 or S109, control unit 40 counts the executed times of the initialization executions.

At step S107, control unit 40 decides whether or not the executed times of the initialization is greater than a fourth predetermined number. When the decision at step S107 is negative, the routine jumps to an end block to terminate the present routine. When the decision at step S107 is affirmative, the routine proceeds to step S108.

At step S108, control unit 40 decides that the valve now diagnosed is not good. Further, control unit 40 displays this abnormal condition and decides not to execute the initialization procedure. Then, the routine proceeds to the end block to terminate the present routine.

In this routine, steps S102 and S103 decides that the crank angle is not within a range from the first predetermined angle through TDC to the second predetermined angle. When the crank angle is within the range, control unit 40 decides that it is not possible to execute the initialization operation and therefore the routine proceeds to step S109. That is, the decision and the avoiding the initialization are executed in order to prevent the contact between the valves 2 and 3 and the piston. More specifically, when the piston position is at a predetermined near range corresponding to the range from the first predetermined angle through TDC to the second predetermined angle and if the initialization operation is executed, the valve may collide with the piston. Therefore, during this range, the initialization operation is stopped. Further, when engine speed N is greater than the predetermined speed, the initialization operation is also stopped. That is, since the initialization operation takes a predetermined time period, there is a possibility that the time period for processing the initialization operation becomes greater than a time period taken for passing the range between the first and second predetermined angles under the high engine speed. Further, the engine control system according to the present invention may be arranged to stop the fuel injection to the specific cylinder including the abnormal valve 2, 3 when the engine speed N is greater than a predetermined value so as to positively prevent the engine speed from becoming greater than another predetermined value.

The process of steps S102, S103 and S104 in the above-mentioned routine is an example for setting a contactable range between the valve and the piston in view of geometry. The necessary condition may be decided from the construction of the valve mechanism and the characteristic thereof.

When the condition of the valve 2, 3 is not within the condition decided in the process of steps S102, S103 and S104, control unit 40 decides that it is possible to execute the initialization process and therefore the routine proceeds to step S105 wherein the initialization execution flag is set. The initialization execution flag is employed in the initialization execution routine based on the flowchart of FIG. 23.

At step S111, control unit 40 executes the initialization process discussed in the explanation of FIG. 9. When the initialization operation is terminated, the routine proceeds to step S112 wherein an initialization termination flag is set. By the execution of this initialization process, the recoverable abnormal condition is recovered and the valve performs normally thereby.

When the abnormality of valve 2, 3 is caused by the mechanical trouble, valve 2, 3 cannot return to the normal condition even by the execution of the initialization operation. Therefore, by the execution of the initialization execution flag setting process corresponding to step S105, the times of setting the initialization termination flag are counted at step S106 after the execution of the initialization execution process corresponding to steps S111 and S112. When the abnormality of valve 2, 3 is temporal, the abnormal condition of valve 2, 3 is returned to the normal condition by executing the initialization process once, and therefore the times of the executions of initialization is stayed at one. On the other hand, when the abnormality of valve 2, 3 is not temporal due to the mechanical trouble, the abnormal condition is not returned to the normal condition. Therefore, under this non-temporal abnormal condition, the decision of the abnormality and the initialization process are repeated. Therefore, the times of the initializations is counted by executing step S106. Then, when it is decided at step S107 that the counted times becomes greater than the predetermined number, the programmed routine proceeds to step S108 wherein it is decided that the abnormal condition of the valve 2, 3 is not temporal. As far as the number of times of the initializations is smaller than the predetermined number, the routine of FIG. 22 is repeated from step S101. The predetermined times for deciding the kind of the abnormality is determined taking account of the degree of the recovery from the abnormal condition through various experiments.

Figure 24:
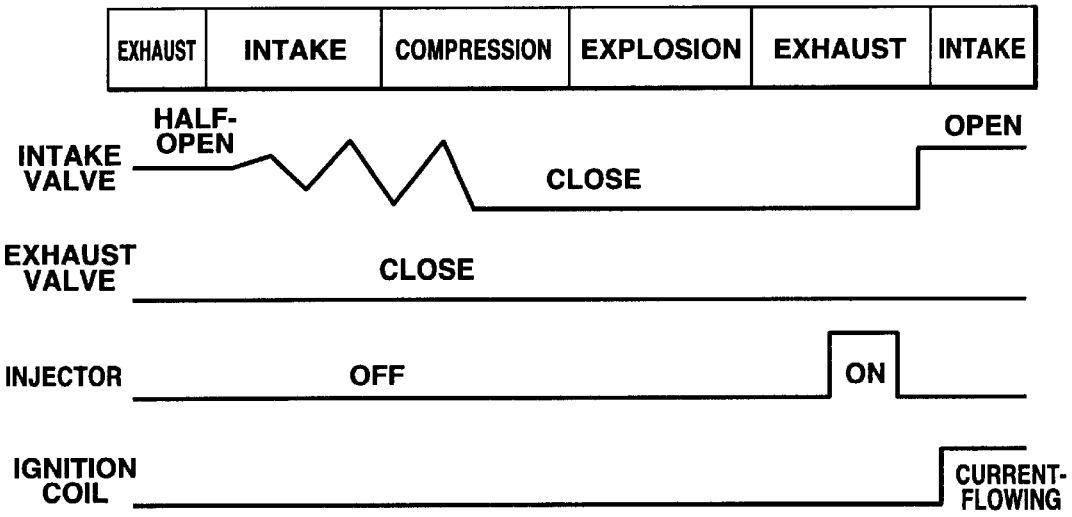
FIG. 24 is a time chart showing operating conditions of main parts in every stroke in a case that the initialization process is executed against the abnormality of the intake valve.

Next, there will be discussed the behavior at the recovery from the abnormal condition through the execution of the initialization procedure when the temporal abnormality of valve 2, 3 is generated, with reference to FIG. 24. In the following explanation, it is assumed that intake valve 2 of a specific cylinder 9 is temporally put into the abnormal condition.

When intake valve 2 of the specific cylinder is put in the abnormal condition, several processes including the stopping fuel injection, closing a normal valve and stopping spark ignition are executed as to the troubled cylinder. Therefore, when the initialization procedure is executed, the specific cylinder including the abnormal intake valve 2, the fuel injection and the ignition are stopped, and the normal valve except for the abnormal valve 2 in the specific cylinder are closed. The abnormal intake valve 2 is put in the half-open condition.

The initialization procedure is executed when the piston is apart from TDC during the intake stroke and the compression stroke. This initialization procedure excites the vibration of the abnormal valve 2, then stays the valve 2 at a closing position. When the valve 2 is returned to the normal position by this initialization procedure, control unit 40 decides that the valve 2 is returned to the normal condition and can start the normal valve operation, fuel injection and ignition.

Although the embodiment according to the present invention has been shown and described to detect the abnormality of the valve from the output signal of lift quantity sensor 34 for measuring the displacement of the valve 2, 3, it will be understood that the detection method for detecting the abnormality of the valve 2, 3 may not be limited to this method and may employ other method, such as a method for detecting the abnormality from the vibration of the valve operation or a method for detecting the abnormality from the electrical characteristic of the objective coil.

Although the embodiment according to the present invention has been shown and described the control system of the engine system equipped with electromagnetically operated valves, the invention is not limited to this and various changes of design may be made in the invention without departing from the spirit of the invention or the scope of the subjoined claims.

With the thus arranged embodiment according to the present invention, even if the abnormality of the valve 2, 3 is generated, the ignition of the spark plug is stopped under the condition that the current-flowing to the primary ignition coil is not started. Therefore, the combustion in the combustion chamber, in the intake passage and in the exhaust passage is avoided. This avoidance prevents engine parts including the catalyst from being degraded by backfire or after-burn. Further, when the abnormality of the valve is generated and even when the ignition of the spark plug has been started, the ignition of the spark plug is executed at the time that the density of fuel in the specific cylinder including the abnormal valve becomes minimum. Therefore, the combustion in the combustion chamber becomes very soft so as to suppress the damages to various parts at minimum.

The entire contents of Japanese Patent Applications No. 11-357638 filed on Dec. 16, 1999 in Japan are incorporated herein by reference.

Although the invention has been described above by reference to a certain embodiment of the invention, the invention is not limited to the embodiments described above. Modifications and variations of the embodiment described above will occur to those skilled in the art, in light of the above teaching. The scope of the invention is defined with reference to the following claims.

What is claimed is:

1. An engine system comprising:

electromagnetically operated intake and exhaust valves;

a spark plug;

a primary ignition coil;

a secondary ignition coil generating an induction voltage according to a current-stopping operation to said primary ignition coil following a current-flowing operation, said secondary ignition coil outputting the induction voltage to said spark plug; and a control unit arranged to decide whether each of intake and exhaust valves is put in an abnormal condition, to close a normal valve of said intake and exhaust valves when one of said intake and exhaust valves is put in the abnormal condition, and to stop the current-flowing to said primary ignition coil when one of said intake and exhaust valves is put in the abnormal condition and when the primary ignition coil does not start the current-following operation.

2. The engine system as claimed in claim 1, wherein said control unit is arranged to delay the current-stopping operation when one of said intake and exhaust valves is put in the abnormal condition and when the primary ignition coil has started the current-flowing operation, and to execute the current-stopping operation when a combustion chamber volume becomes larger than that at a normal ignition.

3. The engine system as claimed in claim 1, further comprising a fuel injector, wherein said control unit is arranged to stop the fuel injection of said fuel injector when one of said intake and exhaust valves is put in the abnormal condition.

4. The engine system as claimed in claim 1, wherein each of said intake and exhaust valves comprises a valve body, an opening electromagnetic coil for moving the valve body toward an opening direction, a closing electromagnetic coil for moving the valve body, a movable member attracted to the opening and closing electromagnetic coils, and a pair of coil springs for biasing the movable member at a neutral position between the opening and closing electromagnetic coils.

5. The engine system as claimed in claim 1, further comprising a lift sensor installed to each of said intake and exhaust valves, said lift sensor detecting a lift quantity of a valve body of each of said intake and exhaust valves, wherein said control unit decides the abnormality of each of said intake and exhaust valves on the basis of a lift quantity indicative signal of the lift sensor.

6. The engine system as claimed in claim 1, wherein said control unit closes said exhaust valve when said intake valve is put in the abnormal condition.

7. The engine system as claimed in claim 1, wherein said control unit closes said intake valve when said exhaust valve is put in the abnormal condition.

8. The engine system as claimed in claim 3, wherein when said control unit decides that said intake valve at a transition from a closing condition to an opening condition is abnormal, said control unit maintains a closing condition of said exhaust valve, stops the fuel injection of the fuel injector, and stops the current-flowing operation during intake stroke.

9. The engine system as claimed in claim 3, wherein when said control unit decides that said intake valve at a transition from an opening condition to a closing condition during a first half of compression stroke is abnormal, said control unit maintains a closing condition of said exhaust valve, stops the fuel injection of the fuel injector, elongates the current-flowing operation and executes the current-stopping operation during a second half of explosion stroke.

10. The engine system as claimed in claim 3, wherein when said control unit decides that the exhaust valve at a transition from an opening condition to a closing condition is abnormal, said control unit sets said intake valve at a closing condition, stops the fuel injection to the fuel injector, and stops the current-flowing to the primary ignition coil during intake stroke.

11. The engine system as claimed in claim 3, wherein when said control unit decides that exhaust valve at a transition from a closing condition to an opening condition at an end of explosion stroke is abnormal, said control unit maintains said intake valve at a closing condition, stops the fuel injection of the fuel injector, and stops the current-flowing operation.

12. An engine control system for an engine system, the engine system having a plurality of cylinders, each cylinder being equipped with electromagnetically operated intake and exhaust valves, a spark plug, a spark-plug drive circuit and a fuel injector, the spark-plug drive circuit including a primary ignition coil and a secondary ignition coil generating an induction voltage according to a current-stopping operation to the primary ignition coil following a current-flowing operation, the secondary ignition coil outputting the induction voltage to the spark plug, said engine control system comprising:

a control unit arranged to decide whether each of intake and exhaust valves is put in an abnormal condition, to close a normal valve of the intake and exhaust valves of a cylinder when one of the intake and exhaust valves of the cylinder is put in the abnormal condition, to stop the current-flowing operation at the cylinder when one of the intake and exhaust valves of the cylinder is put in the abnormal condition and when the primary ignition coil for the cylinder does not start the current-flowing operation, and to stop the fuel injection of the fuel injector of the cylinder when one of the intake and exhaust valves of the cylinder is put in the abnormal condition.

13. The engine control system as claimed in claim 12, wherein said control unit is arranged to delay the current-stopping operation of the cylinder when one of the intake and exhaust valves of the cylinder is put in the abnormal condition and when the primary ignition coil of the cylinder has started the current-flowing, and to execute the current-stopping operation when a combustion chamber volume becomes larger than a combustion chamber volume at a normal ignition.

14. The engine control system as claimed in claim 12, wherein said control unit is arranged to calculate a target intake air quantity from an air quantity for obtaining an engine output according to at least an accelerator depression quantity, to calculate an opening and closing timing of each intake valve from the target intake air quantity, to control the intake valve so as to be opened and closed at the calculated opening and closing timing, to calculate a basic fuel injection quantity for each cylinder on the basis of an detected engine speed and an detected intake air quantity, to control the fuel injector so as to inject the basic fuel injection quantity, to calculate the opening and closing timing so as to supply the target intake air quantity to each of cylinders except for the cylinder including the abnormal valve when the valve of the cylinder is abnormal, and to calculate the basic fuel injection quantity for each cylinder on the pre-condition that the total intake air is supplied to the cylinders except for the cylinder including the abnormal valve when the valve of the cylinder is abnormal.

15. The engine control system as claimed in claim 12, wherein said control unit is arranged to calculate a target intake air quantity from an air quantity for obtaining an engine output according to at least an accelerator depression quantity, to calculate an opening and closing timing of each intake valve from the target intake air quantity, to control the intake valve so as to be opened and closed at the calculated opening and closing timing, to calculate a basic fuel injection quantity for each cylinder on the basis of an engine speed and an intake air quantity, and to increase the target intake-air quantity during idling so that the engine speed during idling is increased.

16. The engine control system as claimed in claim 12, wherein said control unit is arranged to calculate a basic fuel injection quantity for each cylinder on the basis of an engine speed and an intake air quantity, to obtain a fuel injection quantity of each cylinder by correcting the basic fuel injection quantity on the basis of an air-fuel ratio in exhaust gases, to control said fuel injector so as to inject the corrected fuel injection quantity, and to stop the correction of the basic fuel injection quantity when the exhaust valve of one of the cylinders is abnormal.

17. The engine control system as claimed in claim 12, wherein when said control unit decides that the intake valve of one of the cylinders is abnormal, said control unit corrects a detected intake air quantity closer to an intake air quantity detected under a normal condition of all intake valves.

18. The engine control system as claimed in claim 12, wherein when said control unit decides that one of the intake and exhaust valves is abnormal, said control unit executes a recovery operation of the abnormal valve.

19. The engine control system as claimed in claim 18, wherein said control unit decides whether it is possible to execute the recovery operation, and said control unit executes the recovery operation when said control unit decides that it is possible to execute the recovery operation.

20. An engine control system for an internal combustion engine, the engine being equipped with electromagnetically operated intake and exhaust valves, said engine control unit comprising:

a spark plug unit installed to each cylinder of the engine;

a valve operation detecting device installed to each of the intake and exhaust valves, said valve operation detecting device detecting motions of each of intake and exhaust valves; and a control unit connected to said spark plug unit and said valve operation detecting device, said control unit being arranged to decide whether each of intake and exhaust valves is put in an abnormal condition, on the basis of a signal of said valve operation detecting device, to close a normal valve of the intake and exhaust valves of a cylinder when said control unit decides that one of the intake and exhaust valves of the cylinder is put in an abnormal condition, and to command said spark plug unit of the cylinder to stop an igniting operation in the cylinder when one of the intake and exhaust valves of the cylinder is put in the abnormal condition and when said spark plug unit of the cylinder does not start the igniting operation.

21. An engine control system for an internal combustion engine which is equipped with electromagnetically operated intake and exhaust valves, a spark plug, a spark-plug drive circuit and a fuel injector, the spark-plug drive circuit including a primary ignition coil and a secondary ignition coil generating an induction voltage according to a current-stopping operation to the primary ignition coil following a current-flowing operation, the secondary ignition coil outputting the induction voltage to the spark plug, said engine control system comprising:

valve abnormality detecting means for deciding whether each of intake and exhaust valves is put in an abnormal condition;

normal valve closing means for closing a normal valve of the intake and exhaust valves when one of the intake and exhaust valves is abnormal; and current-flowing stopping means for stopping the current-flowing to the primary ignition coil when one of the intake and exhaust valves is put in the abnormal condition and when the current-flowing is not started.

22. Method for controlling an engine which is equipped with electromagnetically operated intake and exhaust valves, a spark plug, a spark-plug drive circuit and a fuel injector, the spark-plug drive circuit including a primary ignition coil and a secondary ignition coil generating an induction voltage according to current-flowing and current-stopping operations to the primary ignition coil, the secondary ignition coil outputting the induction voltage to the spark plug, said method comprising:

deciding whether each of intake and exhaust valves is put in an abnormal condition;

closing a normal valve of the intake and exhaust valves when one of the intake and exhaust valves is put in the abnormal condition; and stopping the current-flowing to the primary ignition coil when one of the intake and exhaust valves is put in the abnormal condition and when the current-flowing is not started.

* * * * *